United States Patent [19]

Yamaga et al.

[11] 4,217,804

[45] Aug. 19, 1980

[54] ELECTRONIC MUSICAL INSTRUMENT WITH AUTOMATIC ARPEGGIO PERFORMANCE DEVICE

[75] Inventors: Eiichi Yamaga; Akira Nakada; Takatoshi Okumura; Eiichiro Aoki; Akiyoshi Oya; Yasuji Uchiyama, all of Hamamatsu, Japan

[73] Assignee: Nippon Gakki Seizo Kabushiki Kaisha, Hamamatsu, Japan

[21] Appl. No.: 952,098

[22] Filed: Oct. 17, 1978

[30] Foreign Application Priority Data

Oct. 18, 1977 [JP] Japan ..... 52-124947
Nov. 4, 1977 [JP] Japan ..... 52-132368

[51] Int. Cl.[3] ..... G10H 1/38; G10H 1/42

[52] U.S. Cl. ..... 84/1.03; 84/1.24; 84/DIG. 12; 84/DIG. 22

[58] Field of Search ..... 84/1.03, 1.24, DIG. 12, 84/DIG. 22

[56] References Cited

U.S. PATENT DOCUMENTS

| | | | |
|---|---|---|---|
| 3,842,184 | 10/1974 | Kniepkamp et al. | 84/1.03 X |
| 3,854,366 | 12/1974 | Deutsch | 84/1.24 |
| 4,059,039 | 11/1977 | Carlson | 84/DIG. 22 |
| 4,080,862 | 3/1978 | Hiyoshi et al. | 84/1.24 |
| 4,106,385 | 8/1978 | Roberts | 84/1.24 |
| 4,148,241 | 4/1979 | Morez et al. | 84/1.03 |
| 4,154,131 | 5/1979 | Studer et al. | 84/1.03 |
| 4,156,379 | 5/1979 | Studer | 84/1.03 |
| 4,158,978 | 6/1979 | Hiyoshi et al. | 84/1.03 |
| 4,171,658 | 10/1979 | Aoki et al. | 84/1.03 |
| 4,179,970 | 12/1979 | Faulkner | 84/1.03 |
| 4,184,401 | 1/1980 | Hiyoshi et al. | 84/1.03 |
| 4,186,640 | 2/1980 | Hiyoshi et al. | 84/1.03 |

*Primary Examiner*—S. J. Witkowski
*Attorney, Agent, or Firm*—Spensley, Horn, Jubas & Lubitz

[57] ABSTRACT

An electronic musical instrument having a channel processor. The channel processor includes a tone production assignment circuit and an automatic arpeggio circuit. The tone production assignment circuit includes a key code memory circuit of a plurality of channels and an assignment control unit. A specific channel among the channels is used exclusively for the automatic arpeggio performance while the other channels are used for ordinary respective tone production corresponding to depressed keys by an ordinary key assignment operation responsive to depression of the keys. The automatic arpeggio circuit produces key codes one after another for the automatic arpeggio channel in accordance with the key codes already assigned to the respective ordinary channels and with arpeggio constituent orders in a sounding pattern. The arpeggio sounding pattern which is selected in response to a rhythm to be played contains binary data representing the arpeggio constituent orders. The arpeggio constituent orders herein mean the orders of the locations of the notes constituting the arpeggio alignment, the order being counted from the lowest one of the depressed keys in a predetermined keyboard range.

11 Claims, 68 Drawing Figures

FIG. 1 (a) PRIOR ART
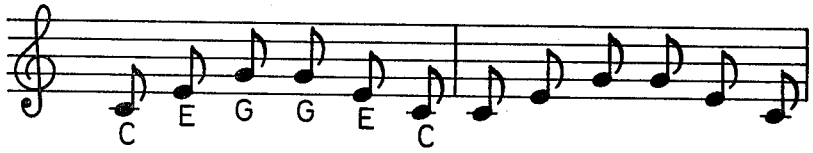
FIG. 1 (b) PRIOR ART
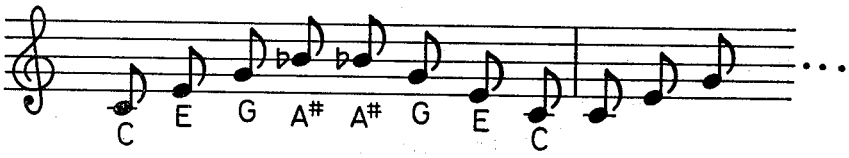
FIG. 12 (a)
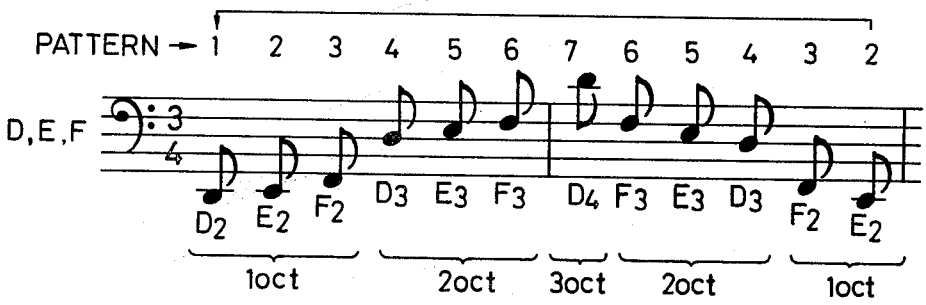
FIG. 12(b)
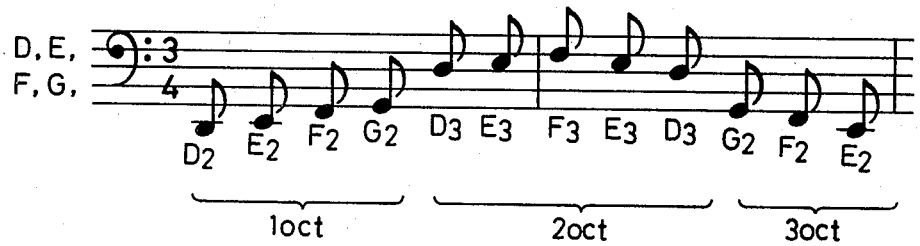
FIG. 12 (c)
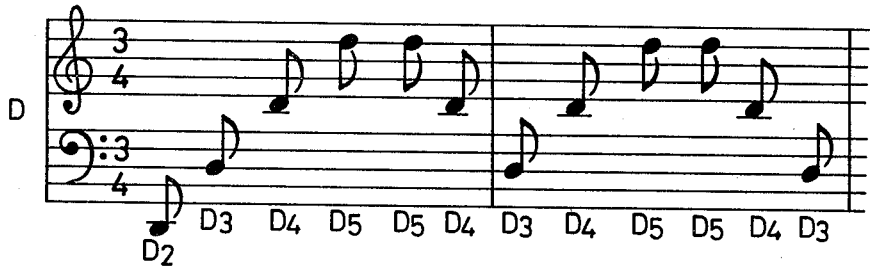

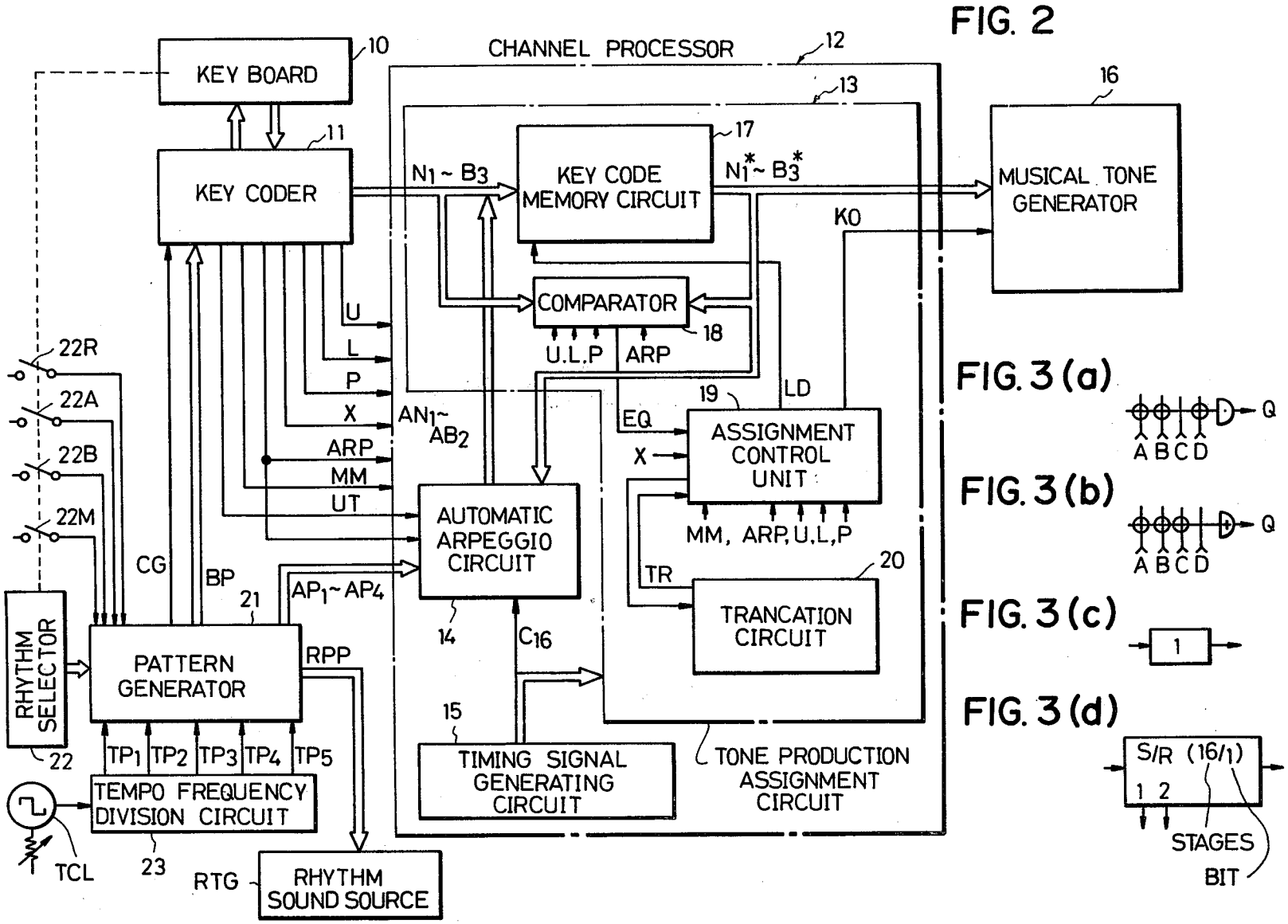
FIG. 2
FIG. 3(a)
FIG. 3(b)
FIG. 3(c)
FIG. 3(d)
MUSICAL TONE GENERATOR
16
CHANNEL PROCESSOR
12
13
KEY CODE MEMORY CIRCUIT
17
COMPARATOR
18
ASSIGNMENT CONTROL UNIT
19
TRANCATION CIRCUIT
20
TONE PRODUCTION ASSIGNMENT CIRCUIT
AUTOMATIC ARPEGGIO CIRCUIT
14
TIMING SIGNAL GENERATING CIRCUIT
15
KEY BOARD
10
KEY CODER
11
PATTERN GENERATOR
21
TEMPO FREQUENCY DIVISION CIRCUIT
23
RHYTHM SOUND SOURCE
RTG
RHYTHM SELECTOR
22
TCL
22R
22A
22B
22M
S/R (16/1)
STAGES
BIT CHANNEL TIME SLOTS
1 2 3 4 5 6 7 8 9 10 11 12 13 14 15 16
1μs
(a)
(b) YUK
(c) YLK
(d) YPK
(e) YAR
(f) H1
(g) H2
(h) H3
(i) ΦA
(j) ΦB
(k)
(l) Y48
(m) $\overline{Y48}$
(n) C16
FIRST PROCESSING PERIOD
SECOND PROCESSING PERIOD
THIRD PROCESSING PERIOD
ONE KEYCODE DELIVERY TIME
16μs
Y48
TIME FROM KEY CODE MEMORY 17
COMPARATOR
NOTE COUNTER
ARPEGGIO REGISTER
ADDER
COUNTER
RESET
TONE NUMBER COUNTER
ARPEGGIO PATTERN REGISTER
TO KEY CODE MEMORY 17
(UP/DOWN)

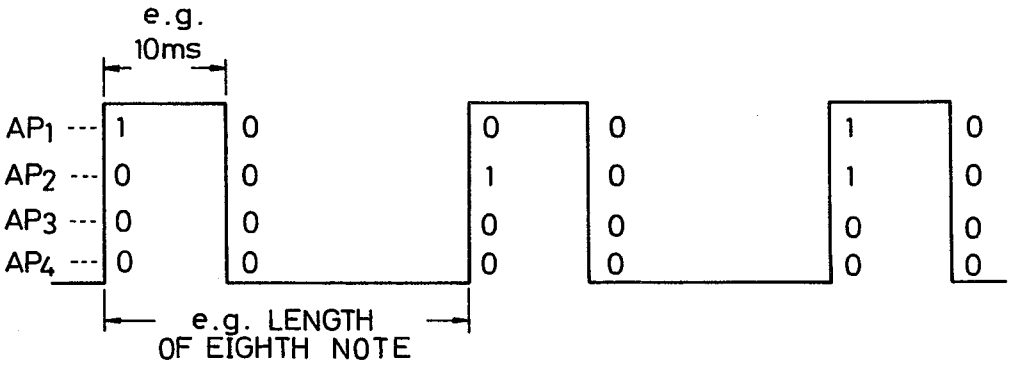
FIG. 9(a)
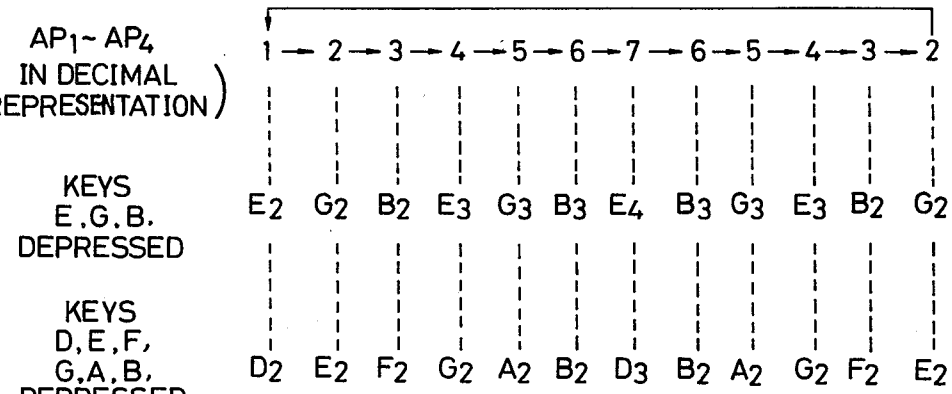
FIG. 9(b)
KEYS
E, G, B,
DEPRESSED
FIG. 9(c)
KEYS
D, E, F,
G, A, B,
DEPRESSED
FIG. 9(d)

(a) F1
(b) F2
(c) STATE
(d) APL
(e) C16
(f) T1
(g) L1
(h) CON
(i) T2 (L2)
(j) AEQ
(k) ART
(l) ARP
(m) AN1 ~ AB2
REPETITION OF ST1 AND ST2 WHEN AEQ IS NON-COINCIDENCE
ST0
ST1
ST2
ST3
1μs
COUNT UP EVERY 16μs
COUNT UP EVERY 16μs
COUNT UP BY NUMBER OF CON
NON-COINCIDENCE
COINCIDENCE
0
TIME (AP1~AP4) → 1 3 2 3 1 3 2 3
D2 F2 E2 F2 D2 F2 E2 F2

(AP1~AP4) → 1 3 5 3 1 3 5 3
D2 F2 E3 F2 D2 F2 E3 F2

(AP1~AP4) → 2 3 4 3 5 4 3 2
E2 F2 D3 F2 E3 D3 F2 E2

(OCTAVE) 1 2 3 0 0 3 2 1
(ORDER) 1 1 1 1 1 1 1 1

(OCTAVE) 1 1 2 2 3 2 2 1
(ORDER) 1 2 1 2 1 2 1 2

(OCTAVE) 1 1 1 2 2 2 3 3 3 3 3 2 2 2 1 1
(ORDER) 1 2 3 1 2 3 1 2 3 2 1 3 2 1 3 2

(OCTAVE) 1 1 1 1 2 2 2 2 3 2 2 2 2 1 1 1
(ORDER) 1 2 3 4 1 2 3 4 1 4 3 2 1 4 3 2

ELECTRONIC MUSICAL INSTRUMENT WITH AUTOMATIC ARPEGGIO PERFORMANCE DEVICE

BACKGROUND AND SUMMARY OF THE INVENTION

This invention relates to an electronic musical instrument capable of producing a plurality of musical tones such as those used in an automatic arpeggio performance in a selected sequence.

An electronic musical instrument capable of performing the automatic arpeggio has been disclosed in the specification of U.S. Pat. No. 4,158,978, assigned to the same assignee as the present case.

In the prior art electronic musical instrument, single or plural tones are designated by key depression as arpeggio constituting tones (constituents) and such arpeggio constituents are sounded one by one in the order of the tone pitch. There are generally two modes in the order of tone production, namely an "up mode" and a "turn mode". In the up mode, the arpeggio constituents are sounded upwardly from the lowest tone and, after finishing sounding of arpeggio constituents in a certain octave, arpeggio constituents which are one octave higher are sounded also upwardly from the lowest tone in this octave range. Such sequential sounding of the arpeggio constituents is repeated over a range of several octaves and, upon reaching the highest predetermined octave, the sequential sounding of the arpeggio constituents is skipped back to the initial octave and reiterated from the initial octave. In the turn mode, the arpeggio constituents are sounded sequentially from the lowest tone upwardly until the highest octave is reached. Upon reaching the highest octave, the arpeggio constituents are subsequently sounded sequentially from the highest tone downwardly with the octave range being sequentially lowered to the initial octave (the lowest octave). Thus rise and fall of the arpeggio constituents are repeated in the turn mode.

In the prior art electronic musical instrument in which the arpeggio constitutents are sounded in turn has a disadvantage that length of a phrase differs depending upon the number of notes constituting an arpeggio. For better understanding of this fact, arpeggio performance in the turn mode employing three notes and four notes as the arpeggio constituents are shown by musical notation in FIGS. 1(*a*) and 1(*b*). In the example shown in FIG. 1(*a*) in which keys for three notes of C, E and G are depressed, arpeggio is formed by repeating sounding of six tones, i.e., C. E. G. G, E and C. For this reason, one phrase consists of six eighth notes. On the other hand, in the example shown in FIG. 1(*b*) in which keys for four notes of C, E, G and A♯ are depressed, arpeggio is formed by repeating sounding of eight tones, i.e., C, E. G, A♯, A♯, G, E and C. One phrase therefor consists of eight eighth notes. Accordingly, length of one phrase in the case where three keys are depressed is different from that in the case where four keys are depressed. As a result, discrepancy in the length of phrase occurs during a series of automatic arpeggio performance if the number of keys which are depressed for the arpeggio performance is changed (e.g. from three notes to four notes) and a smooth automatic arpeggio cannot be obtained.

It is an object of the present invention to eliminate the above described disadvantage by providing an electronic musical instrument according to which length of phrase does not change even if the number of arpeggio constituents changes during a series of the automatic arpeggio performance, e.g. performance of one musical piece.

In a prior art electronic musical instrument of a type in which an automatic rhythm performance can be conducted concurrently with the automatic arpeggio performance, phrases of the automatic rhythm performance are not necessarily synchronized with those of the automatic arpeggio performance, because development of the automatic arpeggio is made independently from the automatic rhythm.

It is therefore another object of the invention to synchronize the phrases of the two types of the automatic performances with each other.

There is also a disadvantage in the prior art electronic musical instrument that the automatic arpeggio is formed, as shown in FIGS. 1(*a*) and (*b*), by simply sounding the arpeggio constituting tones from the highest tone downwardly or from the lowest tone upwardly in the order of tone pitch and this introduces monotonousness in the automatic arpeggio performance.

In view of this, it is still another object of the invention to eliminate such monotonousness from the automatic rhythm performance by achieving an arpeggio performance in which arpeggio constituents are sounded not only in the order of tone pitch but also in an irregular or complicated order of sounding. According to the invention, such a complicated arpeggio can be obtained simply and in various modes.

For achieving the above described objects, the present invention is so constructed that arpeggio is developed not by simply sounding tones designated by depressed keys as arpeggio constituents in the successive order of tone alignment but by sounding the arpeggio constituents in accordance with a cetain predetermined pattern which will hereinafter be referred to as "arpeggio pattern". As such as arpeggio pattern, various patterns can be formed, both simple and complicated, and a desired one can be selected from among them. The automatic arpeggio is performed in accordance with this selected arpeggio pattern and in a certain predetermined mode of tone production so that length of one phrase, the number of arpeggio included in one phrase and a mode of change in the tone pitch do not change even if there is a change in the number of notes constituting the arpeggio during the automatic arpeggio performance.

The arpeggio pattern designates the timings at which the arpeggio tones are to be sounded and which tone among arpeggio constituent is to be sounded at each of the timings. Among automatic performances there is an automatic bass performance, but this is another thing as is conducted in accordance with a degree designation pattern. The bass performance pattern used in the automatic bass performance designates bass note degrees in terms of note intervals between the respective notes to be sounded and the root note. In the arpeggio pattern, however, it is not desirable to designate the respective arpeggio constituents in terms of note intervals as in the case of the bass pattern, because a note identified by the note interval from the root is not always the one included as the arpeggio constituent designated by the key depression.

According to the invention, the arpeggio pattern designates the tones to be sounded by the location order of the tone as counted from the lowest or highest side of the arpeggio constituents. If, for example, the arpeggio pattern designates a number "1" at a certain timing of tone production, the lowest tone among the arpeggio constituents is sounded whereas if the arpeggio pattern designates "2", the second lowest tone among the arpeggio constituents is sounded. If the order number designated by the arpeggio pattern is greater than a total number of the depressed keys, the excessive number is counted back from the starting number but with its location octave is raised by the number of times of such counting back. If, for example, a number "4" is designated by the arpeggio pattern when the number of depressed keys is three (i.e., the number of the arpeggio constituents within an octave is three) the lowest note among the arpeggio constituents within an octave is sounded at a tone pitch which is one octave higher. Alternatively, the octave may not be designated automatically, but by a separate (e.g. manually appointed) octave information.

Another aspect of the invention is that a tempo clock pulse for establishing the timing of the arpeggio pattern is used also as a tempo clock pulse for establishing the timing of the automatic rhythm pattern, and the arpeggio pattern is automatically switched in accordance with a rhythm type selected in the automatic rhythm performance whereby a phrase of the automatic arpeggio is made to coincide with that of the automatic rhythm. The arpeggio pattern is automatically selected depending upon such factors as the meter of the selected rhythm, e.g. three-quarters meter, four-quarters meter, etc. and whether the basic beat of the rhythm is divided into triplets or into ordinary two's power.

According to the present invention, the automatic arpeggio performance is conducted in accordance with the arpeggio pattern and, accordingly, once a pattern to be used has been selected, the phrase of the arpeggio performance, i.e., length of one phrase, timing of production of the arpeggio tones and an overall tendency of tone pitch progression, does not change no matter how the number of the arpeggio constituents may be changed. Accordingly, the arpeggio performance can be smoothly conducted without occurrence of awkward irregularities.

Since the arpeggio pattern can be generated in the same system as the rhythm pattern, some elements such as a tempo signal for setting a tone production timing and a tempo frequency dividing circuit can be commonly used for both the automatic rhythm performance and the automatic arpeggio performance whereby a phrase in the automatic rhythm performance and that in the automatic arpeggio performance can be accurately synchronized.

Further, according to the present invention, any arpeggio pattern, no matter how complicated and irregular it may be, can be selected as desired (by setting of a read-only memory or the like) and the automatic arpeggio can be developed accurately in accordance with such complicated arpeggio pattern so that the kind of the arpeggio pattern can be increased and monotonousness in the automatic arpeggio performance can be eliminated.

The above described objects and features of the present invention will become apparent from description made hereinbelow in conjunction with the accompanying drawings.

BRIEF DESCRIPTION OF THE DRAWINGS

In the drawings,

FIGS. 1(*a*) and 1(*b*) are diagrams showing an example of the prior art automatic arpeggio performance in the form of a staff notation;

FIG. 2 is a block diagram schematically showing an overall construction of an embodiment of the electronic musical instrument according to the invention;

FIGS. 3(*a*) to 3(*d*) are diagrams showing symbols used for designating circuit elements used in the circuits of the present invention;

FIGS. 9(*a*) to 9(*d*) are graphical diagrams schematically showing the arpeggio pattern;

FIGS. 12(*a*) to 12(*c*) are diagrams showing, in staff notation, states of the automatic arpeggio performance conducted in accordance with the same arpeggio pattern in which the number of arpeggio constituting tones is different from each other;

DESCRIPTION OF PREFERRED EMBODIMENTS

Figure 4:
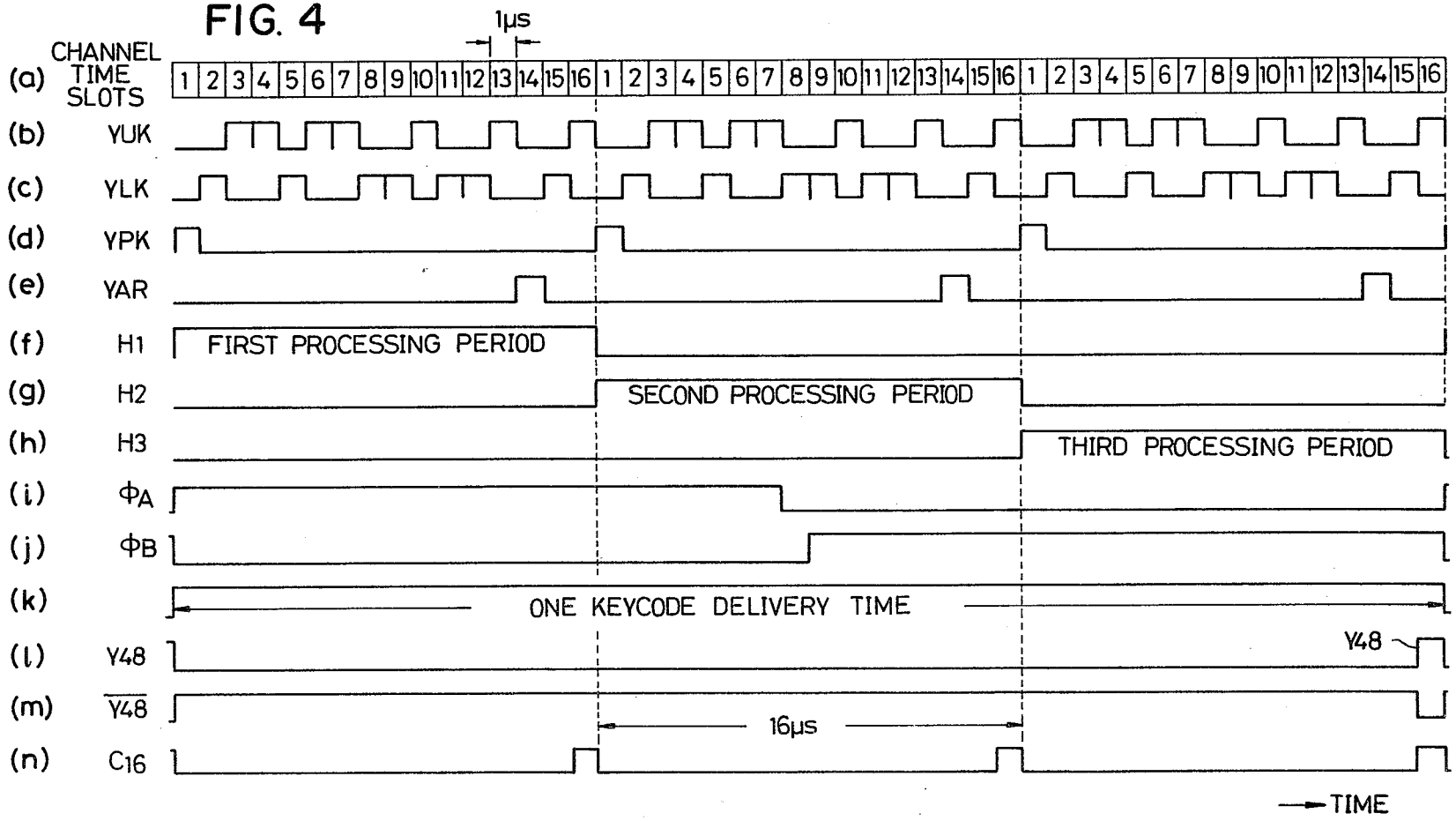
FIGS. 4(*a*) to 4(*n*) are time charts illustrative of various timing signals used in the channel processor shown in FIG. 2.

Referring to FIG. 2, a keyboard 10 includes an upper keyboard, and various control switches. A key coder 11 detects an on or off state of keys of these keyboards and control switches and thereupon delivers out information representative of a state of a depressed key and various control information. A channel processor 12 includes a tone production assignment circuit 13, an automatic arpeggio circuit 14 and a timing signal generation circuit 15 which is provided for controlling timing of operations of the circuits in the channel processor 12.

In the electronic musical instrument according to the present invention, there are provided a suitable number (e.g. 15) of tone production channels to which information (i.e. key code $N_1$-$B_3$) representing depressed keys produced by the key coder 11 is assigned and another tone production channel for a special performance effect to which an automatic arpeggio tone is exclusively assigned. The tone production assignment circuit 13 assigns production of a tone designated by a key code $N_1$-$B_3$ supplied by the key coder 11 to one of the tone production channels. The tone production assignment circuit 13 also assigns production of a tone designated by a key code $AN_1$-$AB_2$ for the automatic arpeggio tone supplied by the automatic arpeggio circuit 14 to the tone production channel exclusively spared for the automatic arpeggio performance. The tone production assignment operation which the circuit 13 performs in response to the key code $N_1$-$B_3$ provided by the key coder 11 is hereinafter referred to as an "ordinary assignment operation".

A musical tone generator 16 is capable of generating each individual musical tone separately with respect to each one of the tone production channels and thus generating musical tones assigned to some of the tone production channels by the tone production assignment circuit 13. As the musical tone generator 16, a suitable construction may be employed, e.g. a type wherein musical tones assigned to respective tone production channels are read out in a time division manner from musical tone waveform memories or a type wherein digital tone generators associated with the respective tone production channels are provided in parallel.

In the tone production assignment circuit 13, a key code memory circuit 17 has a specific number (e.g. 16) of storage positions corresponding to the number of the tone production channels and gate means provided on the input side. Key code $N_1$-$B_3$ provided by the key coder 11 is stored in one of the storage positions of the key code memory circuit 17 by the "ordinary assignment operation". Basic conditions for the ordinary assignment operation in the tone production assignment circuit 13, for example, are (A) The production of a tone is assigned to a channel to which no assignment has yet been made, i.e. an empty channel and (B) Production of a tone of a key being depressed is not assigned to plural channels.

As to the condition (B), however, if the same key code as the old key code which has been assigned to a channel in which production of a tone is not presently being made (i.e. the key for the tone is not being depressed) is supplied newly, the new key code is assigned to another channel. Such assignment control will be observed in a "key-on again" operation to be described later.

It should be noted that the above condition (B) is applicable only to the ordinary assignment operation and a tone assigned to a certain channel by the ordinary assignment operation can be the same as a tone assigned to the tone production channel allotted exclusively for the automatic arpeggio performance.

The various circuits of the tone production assignment circuit 13 function mainly for the ordinary assignment operation. A key code comparison circuit 18 compares key code $N_1$-$B_3$ from the key coder 11 with key code $N_1$*-$B_3$* which stored in a key code memory circuit 17 and has already been assigned to one of the tone production channels and produces a comparison output EQ in accordance with coincidence or non-coincidence. An assignment control unit 19 detects whether the conditions (A) and (B) have been satisfied or not and, if these conditions have been satisfied, produces a load-signal LD for causing the input key code $N_1$-$B_3$ to be stored in the key code memory circuit 17. A new tone production assignment is thereby effected. The assignment control unit 19 produces a key-on signal KO which represents that the key assigned to a certain channel is presently being depressed. A truncate circuit 20 detects a channel to which the oldest key among released keys (i.e. a key which was released more earlier than any other keys) is assigned and, upon detection of such key, produces a truncate channel designation signal TR. The assignment control unit 19 cancels the old assignment designated by the truncate signal TR and assigns a newly depressed key to this particular channel.

The automatic arpeggio circuit 14 generates information of tones to be generated in the automatic arpeggio tone production channel (i.e. arpeggio key codes $AN_1$-$AB_2$) in response to information of tones which have already been assigned to some of the tone production channels (i.e. output key codes $N_1$*-$B_1$*) of the key code memory circuit 17. More specifically, the automatic arpeggio circuit 14 sequentially selects key codes of depressed keys in a predetermined keyboard, e.g. a lower keyboard, from among the key codes $N_1$*-$B_3$* stored in the key code memory circuit 17 one by one and generates the key codes $AN_1$-$AB_2$ for the automatic arpeggio tones in response to the selected key codes $N_1$*-$B_3$*. These automatic arpeggio key codes $AN_1$-$AB_2$ are supplied to the key code memory circuit 17 in the same manner as if the keys for these key codes $AN_1$-$AB_2$ were depressed and stored in storage positions in the circuit corresponding to the arpeggio tone production channels. A pattern of generation of the automatic arpeggio tones, i.e., a pattern of generation of the automatic arpeggio key codes $AN_1$-$AB_2$, is designated by an arpeggio pattern signal $AP_1$-$AP_4$. This signal $AP_1$-$AP_4$ is generated by a pattern generator 21.

The pattern generator 21 consists of a plurality of read-only memories and can generate not only the arpeggio pattern signal $AP_1$-$AP_4$ but a rhythm pattern pulses RPP, a bass pattern signal BP and a chord tone production timing pulses CG. The rhythm pattern pulses RPP are generated for respective percussion instrument sound at timings at which sounds of the percussion instruments are to be produced. The bass pattern pulses BP are generated at timings at which the automatic bass tones are to be produced and are accompanied by informations representing the note degrees of the bass tones. The chord tone production timing pulses CG are generated at timings at which the automatic chord tones are to be produced.

A rhythm selector 22 consists of switches corresponding to various rhythms and a desired rhythm is selected by operation of an associated switch by the operator. The output of the rhythm selector 22 is applied to the pattern generator 21 for selection of a rhythm pattern, arpeggio pattern, bass pattern and chord tone production timing pattern corresponding to the selected rhythm. One pattern may be considered to correspond to one read-only memory and a read-only memory corresponding to the selected rhythm is selected (i.e. the read-only memory is set in a state in which reading out is possible). One rhythm does not necessarily correspond to one pattern but different rhythm patterns, bass patterns and chord tone production timing patterns can be selected with respect to one rhythm by operation of a rhythm variation selection switch 22R. Similarly, different arpeggio patterns may be selected with respect to one rhythm by operation of an arpeggio variation selection switch 22A. A basic tempo of an arpeggio pattern can be changed by operation of a beat change switch 22B. An arpeggio mode change switch 22M is provided for selecting either the up mode or turn mode in the arpeggio performance. Accordingly, an arpeggio pattern is selected depending upon states of the rhythm selector 22, arpeggio variation selection switch 22A, beat change switch 22B and arpeggio mode change switch 22M.

In the arpeggio pattern, rhythm pattern, bass pattern and chord tone production timing pattern, the arpeggio pattern signal $AP_1$-$AP_4$ (four bits), bass pulses BP and chord tone production timing pulse CG are read out in response to the output of a tempo frequency division circuit 23. The tempo frequency division circuit 23 sequentially frequency-divides a tempo clock pulse generated by a tempo clock pulse oscillator TCL to produce plural frequency-divided outputs $TP_1$-$TP_5$. The frequency-divided outputs $TP_1$-$TP_5$ correspond respectively to lengths of various notes (e.g. assuming that the period of $TP_1$ corresponds to the length of a thirty-second note, $TP_2$ corresponds to a sixteenth note, $TP_3$ to a eighth note and $TP_4$ to a quarter note, $TP_5$ to a half note). The frequency-divided outputs $TP_1$-$TP_5$ are used commonly for the automatic rhythm, automatic arpeggio and automatic bass/chord performances for reading out the pattern signals $AP_1$-$AP_4$, RPP, BP and CG from the pattern generator 21 at timings which are proper to the respective pattern signals.

The rhythm pattern pulses RPP are applied to a rhythm tone generator unit RTG for producing rhythm tones. The bass pattern signal BP and the chord tone production timing pulses CG are applied to the key coder 11 for utilization for the automatic bass/chord performance. The automatic rhythm tones are generated independently by the rhythm tone generator unit RTG whereas the automatic bass tones, the automatic chord tones and the automatic arpeggio tones are generated by the musical scale tone generator 16 in accordance with the tone production assignment in the channel processor 12. Since the present invention is directed to the automatic arpeggio performance, detailed description about generation of the automatic bass tones and the automatic chord tones which are not subject matters of the invention will be omitted.

Detailed description of the constructions and operations of various sections (1) Explanation of a Method of Illustrating various Circuit Elements in the Accompanying Drawings, and Timing Signals:

FIG. 3 shows one example of a method of illustrating various circuit elements in the accompanying drawings. In FIG. 3, the part (a) shows a multiple-input type AND circuit; the part (b), a multiple-input type OR circuit; the part (c), a delay flip-flop, and the part (d), a shift register. In a multiple-input type logical circuit element (the part (a) or (b) in FIG. 2), one input line is provided on the input side of the circuit, a plurality of signal lines are intersected with the input line, and the point of intersection of a signal line for a signal to be inputted to the circuit and the input line is encirculed. Accordingly, the logical expression of the part (a) of FIG. 3 is $Q=A\cdot B\cdot D$, while the logical expression of the part (b) of FIG. 3 is $Q=A+B+C$. The digit "1" in the block indicating a delay flip-flop, as shown in the part (c) of FIG. 3, is intended to mean that input data is delayed by one bit time (one stage). In the part (d) of FIG. 3, the numerator of a fraction indicates the number of the stages included in the shift register, while the denominator indicates the bit number per stage. Where no clock pulse is indicated for a delay flip-flop or a shift register in a drawing, it should be understood that it is driven by a main clock pulse $\phi_1$ (which is, for instance, a two-phase clock pulse having a period of 1 $\mu$s). Where an output is led out of a stage in a shift register, the stage's location order is indicated by a numeral in the block, from which an output line is extended.

In the tone production assignment circuit 13, the tone production channels are formed in time division manner. The time-division time slots of the channels are segregated successively with the timing of the main clock pulse $\phi_1$. In this example, the period of the main clock pulse $\phi_1$ is one $\mu$s. The part (a) of FIG. 4 shows the channel time slots (channel times) in the tone production assignment circuit 13, and sixteen time slots each having a time width of 1 $\mu$s correspond to the first through sixteenth channels respectively.

In this example, the tone production channels are allotted separately according to the keyboards, and the tone production assignment circuit 13 operates to assign the depressed keys in relevant keyboards to any of the tone production channels thus determined. For instance, the upper keyboard keys are assigned to the third, fourth, sixth, seventh, tenth, thirteenth and sixteenth channels, while the lower keyboard keys are assigned to the second, fifth, eighth, ninth, eleventh, twelfth and fifteenth channels. The pedal keyboard key is assigned to the first channel. The fourteenth channel is used for assigning the keys for automatic arpeggio performance. Signals representative of the channels classified separately according to the keyboards and the functions as described above are outputted by the timing signal generating circuit 15.

Figure 5:
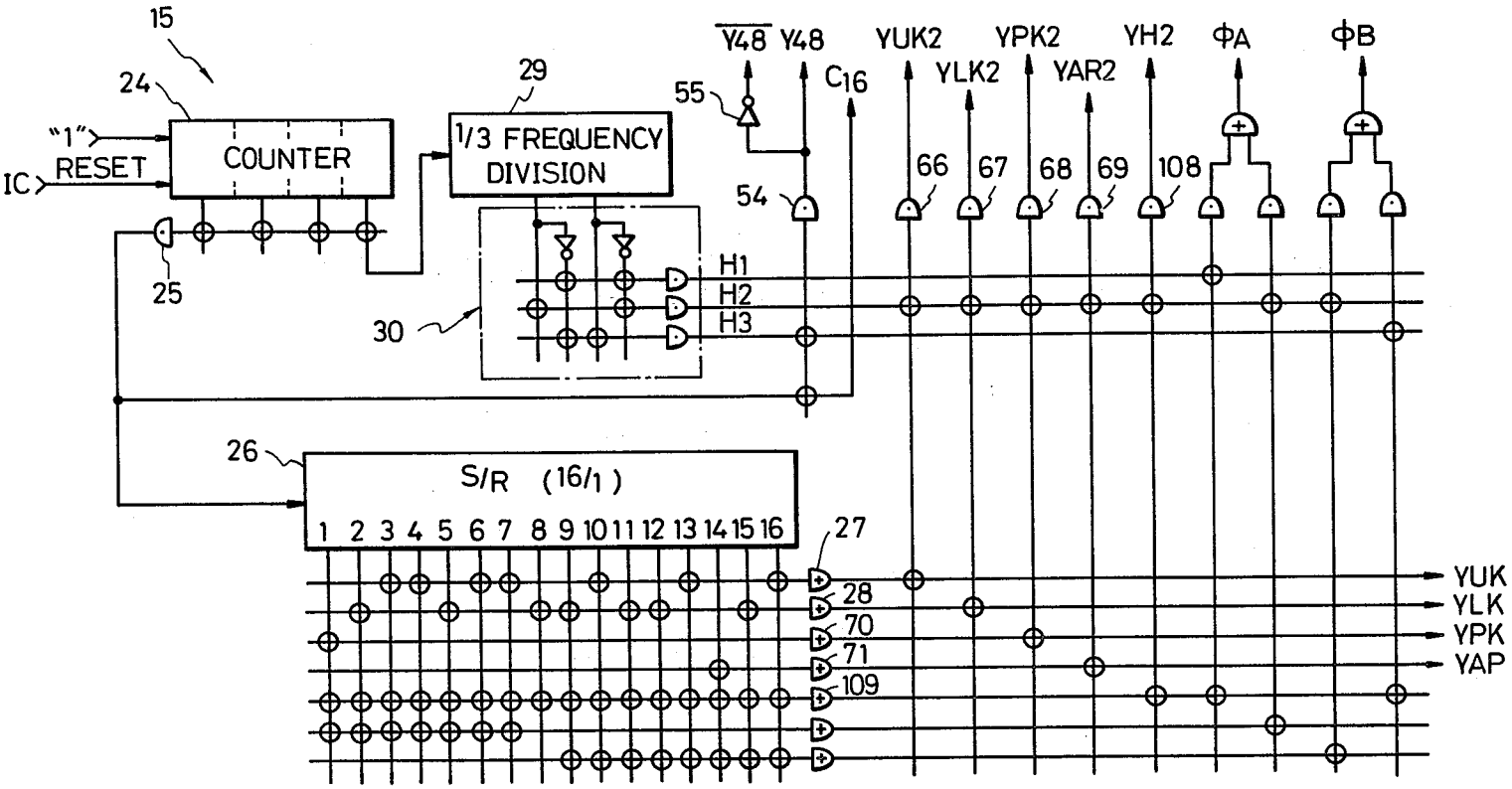
FIG. 5 is a circuit diagram showing the timing signal generation circuit shown in FIG. 2 in detail.

(2) Description of the Timing Signal Generating Circuit 15:

Shown in FIG. 5 is a detailed example of the timing signal generating circuit 15. A counter 24 comprises four cascade-connected ½ frequency division flip-flops for subjecting the main clock pulse $\phi_1$ to 1/16 frequency division. This counter 24 is reset by an initial clear signal IC when the power switch of the instrument is turned on, and thereafter it successively counts DC signals "1" applied to its count input terminal with the timing of the main clock pulse $\phi_1$ (not shown). When the count value of the counter 24 reaches "1 1 1 1". an AND circuit 25 outputs a signal "1" having a time width of 1 $\mu$s. Thus, the AND circuit 25 outputs the signal "1" every 16 $\mu$s, and this output corresponds to the 16th channel time. The output of the AND circuit 25 is inputted into a 16-stage/1-bit shift register 26, where it is successively shifted according to the main clock pulse $\phi_1$ (not shown). Accordingly, a signal "1" is held in the shift register 26, and this signal "1" is successively shifted toward the 16th stage from the first stage, as a result of which the channel time in time division manner as indicated in the part (a) of FIG. 4 is formed. The outputs of the 3rd, 4th, 6th, 7th, 10th and 13th stages in the shift register 26 are applied to an OR circuit 27, the output of which is used as an upper-keyboard-only channel signal YUK. Similarly, the outputs of the 2nd, 5th, 8th, 9th, 11th, 12th and 15th stages in the shift register 26 are applied to an OR circuit 28, the output of which is used as a ower-keyboard-only channel signal YLK. The output of the 1st stage in the shift register 26 is used as a pedal-keyboard-only channel signal YPK. In addition, the output of the 14th stage in the shift register 26 is used as an automatic-arpeggio-only channel signal YAR. The generation of these channels signals YUK, YLK, YPK and YAR are as indicated in the parts (b) through (e) of FIG. 4, respectively.

One cycle of processing operation in the channel processor 12 is accomplished in three circulations (48 μs) of the time division channel time. A signal H1 indicated in the part (f) of FIG. 4 shows the first 16 μs period (the first processing period) of one operation cycle taking 48 μs; a signal H2 indicated in the part (g) of FIG. 4 shows the second 16 μs period (the second processing period); and a signal H3 in the part (h) shows the last 16 μs period (the third processing period). The frequency division signal having a period of 16 μs outputted by the counter 24 in FIG. 5 is inputted to a $\frac{1}{3}$ frequency division circuit 29, from which a 2-bit output which is changed in three ways "0 0", ."0 1" and "1 0" at the time intervals of 16 μs and repeats this change every 48 μs is obtained. This output of the $\frac{1}{3}$ frequency division circuit 29 is applied to a decoder 30, where the first, second and third processing period signals H1, H2 and H3 are obtained in correspondence to the outputs "0 0", "0 1" and "1 0", respectively.

The timing signal generating circuit 15 generates two-phase clock pulses $\phi_A$, and $\phi_B$ each having a period of 48 μs as indicated in the parts (i) and (j) of FIG. 4, in accordance with with the processing period signals H1, H2 and H3 and the contents of the shift register 26. The two-phase clock pulses $\phi_A$ and $\phi_B$ are used in the key coder 11 so as to deliver various data out of the latter 11 in synchronization with the period of 48 μs of each of the first, second and third processing period signals H1, H2 and H3.

(3) Description of the key coder 11

A key coder of the type that is disclosed by the specification of U.S. Pat. No. 4,148,017, assigned to the assignee of the present case may be preferably employed as the key coder 11. The key coder 11 operates to output key codes $N_1$–$B_3$ representative of keys depressed in the keyboard section 10. The key codes $N_1$–$B_3$ are outputted in time division manner at predetermined time intervals when the keys are depressed. This time interval is controlled by the aforementioned clock pulses $\phi_A$ and $\phi_B$ so as to have a time width of 48 μs in synchronization with the period of time from the rise of the pulse $\phi_A$ to the fall of the pulse $\phi_B$. For example, if the key code $N_1$–$B_3$ of a depressed key is applied to the channel processor 12 from the key coder 11 with the time width of 48 μs equal to the period of time from the rise of a clock pulse $\phi_A$ to a clock pulse $\phi_B$, then the key code $N_1$–$B_3$ of another depressed key is applied thereto in the period of time of 48 μs from the rise of the following clock pulse $\phi_A$ to the fall of the following clock pulse $\phi_B$. The time width for delivering one key code $N_1$–$B_3$ from the key coder 11 is as indicated in the part (k) of FIG. 4.

The key code $N_1$–$B_3$ is a 7-bit data consisting of a note code $N_1$, $N_2$, $N_3$, $N_4$ representative of a note and a block code $B_1$, $B_2$, $B_3$ representative of an octave range. One example of the relations between the contents of note codes $N_1$–$N_4$ and notes is indicated in Table 1 below:

Table 1

| Note | $N_4$ | $N_3$ | $N_2$ | $N_1$ | Decimal notation |
|---|---|---|---|---|---|
| C# | 0 | 0 | 0 | 1 | 1 |
| D | 0 | 0 | 1 | 0 | 2 |
| D# | 0 | 0 | 1 | 1 | 3 |

Table 1-continued

| Note | $N_4$ | $N_3$ | $N_2$ | $N_1$ | Decimal notation |
|---|---|---|---|---|---|
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |
| C | 1 | 1 | 1 | 1 | 15 |

The relation-ships between the contents of block code $B_1$–$B_3$ and the octaves are indicated in Table 2 by way of example;

Table 2

| Code Bits | | | Octave Range | | | | | | | |
|---|---|---|---|---|---|---|---|---|---|---|
| | | | Upper keyboard | | Lower keyboard | | Pedal keyboard | | Arpeggio | |
| $B_3$ | $B_2$ | $B_1$ | | | | | | | | |
| 0 | 0 | 0 | $C_3$ | | $C_2$ | | $C_2$ | | | |
| 0 | 0 | 1 | C#3 | C4 | C#2 | C3 | C#2 | C3 | C#2 | C3 |
| 0 | 1 | 0 | C#4 | C5 | C#3 | C4 | C#3 | C4 | C#3 | C4 |
| 0 | 1 | 1 | C#5 | C5 | C#4 | C5 | | | C#4 | C5 |
| 1 | 0 | 0 | C#6 | C7 | C#5 | C6 | | | C#5 | C6 |

As is clear from Table 2, the relationships between block codes $B_1$–$B_3$ and octave ranges are different from one another separately according to the kinds of keyboard. For instance, the key range of the upper keyboard is from note $C_3$ to note $C_7$, that is, notes lower in the tone pitch than note $C_3$ (note $B_2$ and lower notes) and notes higher in tone pitch than note $C_7$ (note C#7 and higher notes) are not used, and even with the same block code $B_1$–$B_3$ the octave range of the upper keyboard is different by one octave from that of the lower keyboard. In addition the octave range represented by the same block code $B_1$–$B_3$ is not an ordinary range of from note C to note B, but a range of from note C# to the next higher note C. Accordingly, the block code $B_1$–$B_3$ "0 0 0" in the lowest range is applied only to one tone C which is the lowest. Indicated in the column "Arpeggio" in Table 2 are tone ranges corresponding to the contents of the block code $AB_1$, $AB_2$ included in a key code $AN_1$–$AB_2$ for automatic arpeggio tones which is provided by the automatic arpeggio circuit 23. The tone ranges are substantially equal to those for the block codes $B_1$–$B_3$ for the lower keyboard; however, it should be noted that note $C_2$ in the lowest tone range is not used in the automatic arpeggio. Accordingly, with respect to the block code $AB_1$, $AB_2$ for arpeggio, a bit corresponding to the third bit $B_3$ is not required. The key range of the pedal keyboard is from note $C_2$ to note $C_4$, and therefore in this case also the data of the third bit $B_3$ is unnecessary.

Keyboard signals U, L, and P representative of keyboards to which the keys represented by the key codes $N_1$–$B_3$ belong are outputted by the key coder 11 in synchronization with the key codes $N_1$–$B_3$ and with a time width of 48 μs. The signals U, L or P represent the upper keyboard, the lower keyboard and the pedal keyboard, respectively.

A depressed key's code $N_1$–$B_3$ and its keyboard signal U, L and P are provided by the key coder 11 repeatedly at suitable time intervals. Upon release of the key, provision of the key code $N_1$–$B_3$ is suspended. In order to detect what key code concerns the released key among the key codes which have been provided, the key coder 11 periodically generates a key-off detecting signal X.

The generation timing of the key-off detecting signal X is 48 μs equal to one key code delivery time indicated in the part (k) of FIG. 4. While this key-off detecting signal X is being produced, none of the key code $N_1$–$B_3$ and the keyboard signals U, L and P are produced. The generation interval of the key-off detecting signal X is of the order of 5 ms for instance. It is a relatively long period of time for a digital system, but it is so short for a person's hearing sense that he cannot distinguish two successively produced key-off detecting signals X. The assignment control section 19 in the tone production assignment circuit section 13, under the conditions that no key code $N_1$–$B_3$ is supplied to the channel processor 12 during one generation interval of key-off detecting signal X although it has been supplied to the channel processor 12, determines that the key concerning the key code $N_1$–$B_3$ has been released.

In this example, the key coder 11 is so designed that it delivers not only information ($N_1$–$B_3$, U, L, P and X) concerning keys as was described above but also data selected by switches employed for musical tone control of function selection. When the automatic arpeggio performance is selected, the key coder 11 outputs an automatic arpeggio selection signal ARP with a time width of 48 μs synchronous with one key code delivery time shown in the part (k) of FIG. 4. Furthermore, the key coder 11 is so designed that when the automatic arpeggio selection signal ARP is outputted, pieces of information ($N_1$–$B_3'$ U, L, P and X) concerning keys are not outputted thereby. The automatic arpeggio selection signal ARP is repeatedly generated in the same manner as the key-off detection signal X and a period of repetition is approximately of the order of 1 ms to 5 ms.

Furthermore, the key coder 11 is so designed that process for automatic bass chord performance can be effected. That is, in the case where the automatic bass chord performance is selected, an automatic bass's key code $N_1$–$B_3$ and an automatic chord's key code $N_1$–$B_3$ are provided with suitable timing in accordance with keys depressed in the keyboard section 10. Accordingly, the key coder 11 produces not only key codes $N_1$–$B_3$ of actually depressed keys but key codes $N_1$–$B_3$ for the automatic arpeggio performance which are automatically generated in response to the key codes of the depressed keys as if the keys for such key codes were actually depressed.

In the "automatic bass chord performance", in general, keys in the keyboard section are depressed in chord form, a chord name is detected from the combination of the keys thus depressed, tones corresponding to the root note and the subordinate notes of the chord are automatically produced as bass tones in accordance with a bass progression pattern, and chord forming tones are produced simultaneously with chord tone producing timing. A bass automatically formed is supplied, as a pedal keyboard key code $N_1$–$B_3$ (i.e. being accompanied by pedal keyboard signal P) to the channel processor 12, while a chord is supplied as a lower keyboard key code $N_1$–$B_3$ (i.e. being accompanied by lower keyboard signal L) to the channel processor 12. In the electronic musical instrument relating to this embodiment a device disclosed in the specification entitled as "Musical Instrument with Automatic Bass Chord performance device" of U.S. Pat. No. 4,184,401 assigned to the same assignee as the present case can be employed for automatic bass chord performance. Such an "automatic bass chord performance control device" is provided on the output side of the key coder 11, that is, it is provided between the key coder 11 and the channel processor 12. However, it should be noted that the "automatic bass chord performance control device" is included in the key code 11 in FIG. 2. In fact, it is possible that by following the teachings of the U.S. Pat. No. 4,184,401 an automatic bass chord performance function can be incorporated in the key coder 11 to commonly use the circuits. Accordingly, this embodiment may employ an arrangement in which an automatic bass chord performance function is positively incorporated in the key coder 11, or it may employ an arrangement in which an original key coder part and an automatic bass chord performance control part are segregated from each other in the key coder 11 which is illustrated as one block for convenience in description. The detailed description of the automatic bass chord performance control will be omitted.

In addition, the key coder 11 outputs a memory signal MM representative of the fact that information representative of a key depressed should be stored even after the release of the key so as to be used for musical tone production, an up/turn selection signal UT for selecting an automatic arpeggio tone's tone pitch increment pattern or increment and decrement repetition pattern by operation of switches corresponding to signals MM and UT.

The up/turn selection signal UT is generated by operation of an arpeggio mode change switch 22M. Rhythm selector 22, rhythm variation selection switch 22R, arpeggio variation selection switch 22A, beat change switch 22B and arpeggio mode change switch 22M are provided in association with the keyboard 10 and the outputs thereof are supplied to circuits which require them via the key coder 11. Detailed illustration is not made in FIG. 2 in this respect. For convenience of explanation, the illustration is made in such a manner that the outputs of the rhythm selector 22 and the switches 22R, 22A, 22B and 22M are supplied directly to the pattern generator 21.

(4) Description of the Tone Production Assignment Circuit 13:

One example of the tone production assignment circuit 13 will be described in detail with reference to FIGS. 6 and 7.

Figure 6:
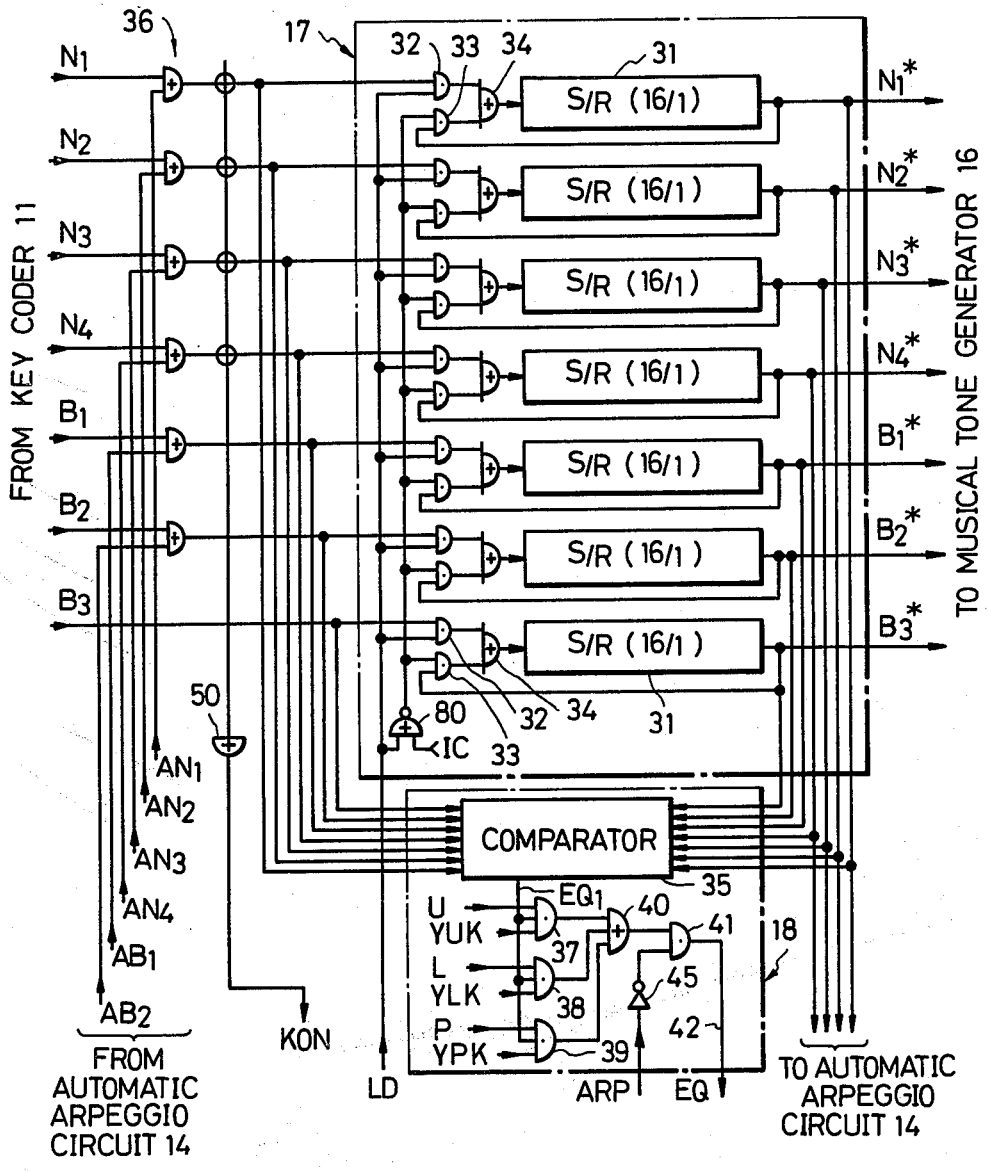
FIG. 6 is a circuit diagram showing the key code memory circuit and the key code comparison circuit shown in FIG. 2 in detail.

Generation of comparison output EQ referring to FIG. 6, the key code memory circuit 17 comprises a 16-stage/1-bit shift register 31, a data inputting AND circuit 32, a selfholding AND circuit 33 and an OR circuit 34 for supplying input data to the first stage of the shift register 31 for each bit of the key code $N_1$–$B_3$. Each shift register 31 carries out its shifting operation every 1 μs in accordance with the main clock pulse $\phi_1$. The number of stages in the shift register 31 corresponds to the number of tone production channels. The key codes $N_1^*$–$B_3^*$ of tones assigned to the respective channels are stered in time division manner in the stages of the shift register 31. These key codes $N_1^*$–$B_3^*$ are successively outputted by the key code memory circuit 17 in synchronization with the respective channel times, each having 1 μs as indicated in the part (a) of FIG. 3, and are applied to the tone input side of a digital comparator 35 in a key code comparison circuit 18, to the other input side of which the key code $N_1$–$B_3$ having a time width of 48 μs delivered from the key coder 11 is applied through a group of OR circuits 36.

In the digital comparator 35, the key code $N_1$–$B_3$ of a depressed key which is not changed for 48 μs is compared with the key code $N_1^*$–$B_3^*$ which is changed every 1 μs and has been assigned already. In the case where the same key code $N_1$–$B_3$ as the key code $N_1$–$B_3$ has been stored in the memory circuit 17, the coincidence detection signal $EQ_1$ is raised to a logical level "1" (hereinafter referred to as "1" when applicable) in synchronization with the channel time thereof. In the digital comparator 35, the comparison is carried out independently of the keyboard of the key code $N_1$–$B_3$, and the coincidence detection signal $EQ_1$ is produced. The coincidence detection signal $EQ_1$ is applied to AND circuit 37, 38 and 39, whereby only the conicidence detection signal $EQ_1$ which is provided in the channel time of the same keyboard as a keyboard to which a key code $N_1$–$B_3$ supplied from the key coder 11 belongs is selected. For ths this purpose, the upper keyboard signal U or the lower keyboard signal L or the pedal keyboard signal P delivered from the key coder 11 in synchronization with a key code $N_1$–$N_3$ is applied to the AND circuit 37 or 38 or 39, respectively. A key code $N_1$*–$B_3$* is assigned tothe special channel for the respective keyboard, and therefore the signals YUK, YLK and YPK representative of the special channels of the keyboards, as indicated in the parts (b), (c) and (d) of FIG. 4 are applied to the AND circuits 37, 38 and 39. The outputs of the AND circuits 37, 38 and 39 are applied to an OR circuit 40, the output of which is applied, as a comparison output EQ, through an AND circuit 41 and a line 42 to AND circuits 43 and 44 in the assignment control section 19 (FIG. 7). The AND circuit 41 is to suspend the application of the comparison output EQ to the assignment control circuit 19 while the automatic arpeggio selection signal ARP is supplied thereto. In this case, the signal ARP is applied through an inverter 45 to the AND circuit 41 to disable the latter 41. As was described before, while the automatic arpeggio selection signal ARP is being provided, none of the keyboard signals U, L and P are provided. Therefore, the output of the OR circuit may be directly introduced to the line 42 without providing the AND circuit 41. For the period of 48 μs during which the automatic arpeggio selection signal ARP is outputted, the key code $AN_1$–$AB_2$ of an automatic arpeggio tone is applied to the OR circuit 36 by the automatic arpeggio circuit 14 and is stored in the key code memory circuit 17 with the timing corresponding to the fourteenth channel which is the arpeggio special channel. The note code $N_1$*–$B_3$* of the output of the key code memory circuit 17 is supplied to the automatic arpeggio circuit 14.

Generation of new key-on signal NKO

Figure 7:
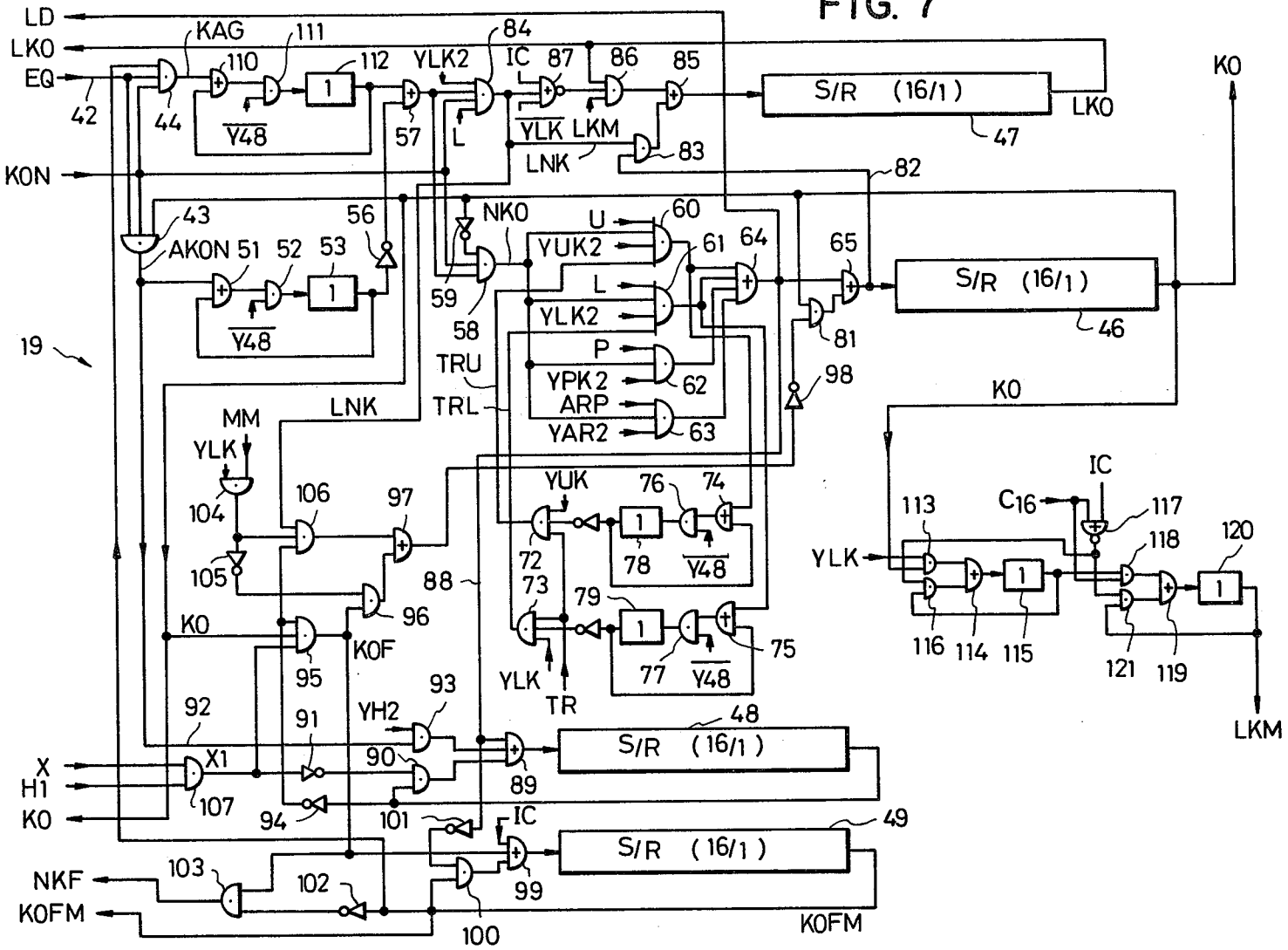
FIG. 7 is a circuit diagram showing an example of the assignment control unit shown in FIG. 2 in detail.

Referring to FIG. 7, the assignment control section 19 comprises a key-on memory 46, a lower keyboard key-on memory 47, a key-on temporary memory 48, a key-off memory 49, and a circuit for controlling the data inputting operations and storage cancelling operations of these memories. Each of the memories 46 through 49 has a 16-stage/1-bit shift register so as to store the data of the channels in time division manner. When a key concerning a key code $N_1$*–$B_3$* which has been assigned and stored in the key code memory circuit 17 is being depressed, a signal "1" (key-on signal KO) is stored by the key-on memory 46 in synchronization with the relevant assigned channel. Accordingly, this indicates that tone assignment has already been done to the channel for which the output of the key-on memory is at "1", and the key of the tone is being depressed. The aforementioned comparison output EQ, the output KO of the key-on memory 46 and a key code detecting signal KON from an OR circuit 50 (FIG. 6) are applied to the AND gate 43. A note code $N_1$–$N_4$ supplied to the key codes 11 (or the note code $AN_1$–$AN_4$ of an automatic arpeggio is inputted to the 4-input OR circuit 50. Accordingly, when any key code $N_1$–$B_3$ is supplied to the key code memory circuit 17, the key code detection signal KON is raised to "1".

Accordingly, the AND circuit 43 outputs a signal "1", when the following three conditions are satisfied:

(1) At present, a key code $N_1$–$B_3$ (or $AN_1$–$AB_2$) is being supplied (KON="1").

(2) The key code $N_1$–$B_3$ as already been assigned to a channel. (EQ="1").

(3) The tone assigned to that channel is of a key being depressed (the output of the key-on memory 46 being at "1"). This output "1" of the AND circuit 43 will be referred to as "an assigned key-on signal AKON" when applicable. The signal AKON is applied through an OR circuit 51 and an AND circuit 52 to a delay flip-flop 53, where it is stored. This storage is self-maintained through the OR circuit 51 and the AND circuit 52. The signal $\overline{Y48}$ applied to the other input terminal of the AND circuit 52 is obtained by inverting a one-cycle-finish signal Y48 (the part (1) of FIG. 4). More specifically, the one-cycle-finish signal Y48 is provided by an AND circuit 54 in the timing signal generating circuit 15 (FIG. 5). The third process period signal H3 from the decoder 30 (the part (h) of FIG. 4) and a pulse synchronous with the 16th channel time from the AND circuit 25 are applied to the AND circuit 54, and the one cycle finish signal Y47 is provided in the last channel time of the process operation cycle as indicated in the part (1) of FIG. 4. Since the signal $\overline{Y48}$ is obtained by inverting the output of the AND circuit 54 by means of an inverter 55, it is maintained at "1" for the period of 47 bit-time covering the first and second process periods (H1 and H2) plus the period from the beginning of the third process period (H3) to the 15th bit-time thereof (cf. the part (m) of FIG. 4). The AND circuit 52 (FIG. 7) enabled by the signal $\overline{Y48}$ is disabled with the generation timing of the one cycle finish signal Y48. Therefore, the self-holding of the delay flip-flop 53 is cleared at the last channel time of the third process period (H3).

In the case where a key code $N_1$–$B_3$ supplied by the key coder 11 in one which has been assigned already, an assigned key-on signal AKON is provided in a relevant assigned channel time of the 16 bit-time during which the first process period signal H1 is outputted. Since this signal AKON is immediately stored in the delay flip-flop 53, the output of the delay flip-flop 53 is maintained at "1" for the period of 16 bit-time during which the second process period singal H2 is outputted. This output "1" of the delay flip-flop 53 is applied to an inverter 56, where its level is switched to a logical "0" level (hereinafter referred to merely as "0" when applicable), as a result of which no new assignment in the second process period (H2) is effected.

In contrast, in the case where a key code $N_1$–$B_3$ supplied by the key coder 11 has not been assigned yet (or in the case where an automatic arpeggio key code $AN_1$–$AB_2$ is supplied), the output of the AND circuit 43 is always at "0" while the first and second process period signals H1 and H2 are outputted. Accordingly, no signal "1" is stored in the delay flip-flop 53, and the output of the flip-flop 53 is maintained at "0". In this case, while the second process period signal H2 is provided, the output of the inverter 56 is at "1" without fail. This output "1" of the inverter 56 is applied through an OR circuit 57 to an AND circuit 58, as a result of which a new key-on signal NKO is provided which indicates the fact that a key is newly depressed. A key code detection signal KON is applied to the AND circuit 58 by the OR circuit 50 in FIG. 6. When the output of the inverter 56 is at "1" and this key code detection signal KON is at "1" also, it means that a new key code $N_1$-$B_3$ which is not assigned yet is supplied. Such a new key code $N_1$-$B_3$ should be assigned to any of the channels. For this purpose, the output of the key-on memory 46 is applied through an inverter 59 and the AND circuit 58, thereby to enable the AND circuit 58 in a channel time during which key release is effected, and to provide the new key-on signal NKO in that channel time.

The new key-on signal NKO outputted by the AND circuit 58 is applied to AND circuits 60, 61, 62 and 63, and it is selected by one of the AND circuits 60 through 63 in synchronization with a single channel time. The new key-on signal NKO thus selected is applied through OR circuits 64 and 65 to the key-on memory 46, where it is stored. The output "1" of the OR circuit 64 becomes a load signal LD. The upper keyboard signal U, the lower keyboard signal L, the pedal keyboard signal P and the automatic arpeggio selection signal ARP are applied to the AND circuits 60 through 63 by the key coder 11, respectively, as a result of which one of the AND circuits 60 through 63, which corresponds to the keyboards (or function) to which the key code $N_1$-$B_3$ being supplied belongs, is enabled. Signals YUK2, YLK2, YPK2 and YAR2 representative of the keyboards and automatic arpeggio exclusive assignment channels are applied to the AND circuits 60 through 63, respectively. These signals YUK2, YLK2, YPK2 and YAR2 are the exclusive channel signals YUK, YLK, YPK and YAR (the parts (b) through (e) of FIG. 4) which occur during the second process period indicated in the part (g) of FIG. 4, and these signals are prodvided by AND circuits 66 through 69 in FIG. 5. The second process period signal H2 is applied to one input terminal of each of the AND circuits 66 through 69 by the decoder 30, while the upper keyboard exclusive channel signal YUK, the lower keyboard exclusive channel signal YLK, the pedal keyboard exclusive channel signal YPK and the automatic arpeggio exclusive channel signal YAR are applied to the remainning input terminals of the AND circuits 66 through 69 by the OR circuits 27, 28, 70 and 71, respectively. Thus, the signals YUK2, YLK2, YPK2 and YAR2 are provided in the exclusive channel times of the second process period, respectively.

Assignment operation to the automatic arpeggio channel

Each of the exclusive channels for the pedal keyboard tone and the automatic arpeggio tone is one channel. Therefore, if the new key-on signal NKO is provided while the pedal keyboard signal P or the automatic arpeggio selection signal is being supplied, the AND circuit 62 or 63 outputs a signal "1" in the first or fourteenth channel time of the second process period in response to the signal YPK2 or YAR2. Accordingly, in the case of the automatic arpeggio tone, the signal "1" outputted from the AND gate 63 is applied to the OR gate 64 and the load signal LD is generated at the automatic arpeggio exclusive channel time (i.e. the fourteenth channel time) whereby the automatic arpeggio key code $AN_1$-$AB_2$ is assigned to he automatic arpeggio exclusive channel.

Ordinary assignment operation (assignment of Upper Keyboard and lower keyboard tones)

Each of the upper keyboard the lower keyboard is allotted with seven channels as its exclusive channels. Therefore, in order to assign the new key-on signal NKO to a single channel, a truncate channel designation signal TR is employed. The signal TR is outputted by the truncation circuit 20 as described later. The truncate channel designation signal TR is provided in synchronization with the assignment channel time of the key which has been released earliest in the upper keyboard and with the assignment channel time of the key which has been released earliest in the lower keyboard with respect to the tones being subjected to assignment. The signal TR thus provided is applied to AND circuits 72 and 73, where it is divided into an upper keyboard truncate channel designation signal TRU and a lower keyboard truncate channel designation signal TRL separately according to the upper keyboard exclusive channel signal YUK and the lower keyboard exclusive channel signal YLK. The signal TRU and TRL are applied to the AND circuits 60 and 61, respectively, whereby the new key-on signal NKO is selected in a single channel time of a relevant keyboard. When a signal "1" is outputted by the AND circuit 60 or 61 once, the signal "1" is applied through an OR circuit 74 or 76 and an AND circuit 76 or 76 to a delay flip-flop 78 or 79, where it is stored. This storage is self-held by the signal $\overline{Y48}$ applied to the AND circuit 76 or 76 until the one cycle finish signal Y48 is provided. The output "1" of the delay flip-flop 78 or 79 is applied through an inverter to the AND circuit 72 or 73 to disable the latter. Accordingly, even if the truncate channel designation signal TR is provided twice or more in different channels relating to one and the same keyboard, the truncate channel designation signal TRU or TRL of the upper keyboard or the lower keyboard is generated only once in the second process period (the part (g) of FIG. 4).

When any of the AND circuits 60 through 63 provides the output "1", a new assignment is carried out. More specifically, the signal "1" outputted by any of the AND circuits 60 through 63 in a single channel time of the second process period is applied, as a load signal LD, through an OR circuit 64 to the key code memory circuit 17 (FIG. 6). Referring to FIG. 6, the load signal LD enables data inputting AND circuits 32 provided respectively for the bits in the key code memory circuit 17. The load signal LD is further applied thorugh a NOR circuit 80 to self-holding AND circuits 33 to disable the latter. Therefore, the stored key code $N_1$*-$B_3$* of a channel for which the load signal LD is provided is cleared, and a new key code $N_1$-$B_3$ (or $AN_1$-$AB_2$) is stored in the key code memory circuit 17 in synchronization with the relevant channel time.

Generation of key-on signal KO

The output "1" of the OR circuit 64 is applied through an OR circuit 65 to the key-on memory 46, whereby the key-on signal KO is stored in synchronization with the storage of the new key code $N_1$-$B_3$ in the key code memory circuit 17. The output KO of the key-on memory 46 is self-held by means of the OR circuit 65 and an AND circuit 81. The AND circuit 81 is disabled in the time of the channel to which a key code $N_1$*-$B_3$* relating to key release has been assigned, as described later.

Accordingly, when the key assigned to a specific tone production channel is being depressed, the key-on signal KO outputted from the key-on memory 46 is "1" at the channel time of the specific channel, and when the key is released, the key-on signal KO is "0". The assignment of a tone to the automatic arpeggio channel (the fourteenth channel) is not based on an actual key depression. In the key-on memory 46, however, the key-on signal is streated as if the key was actually depressed at the timing for producing the automatic arpeggio tone. Accordingly, the key-on signal KO is generated at the channel time for the automatic arpeggio.

Generation of a lower keyboard key-on signal LKO

A lower keyboard key-on memory 47 memorizes the fact that a key in the lower keyboard assigned to one of the tone production channels has been depressed and maintains this storage even after the key in the lower keyboard is released. This lower keyboard key-on memory 47 is provided for preventing irregularity in key release which may occur in releasing lower keyboard keys depressed for the automatic arpeggio performance, for such irregularity in key release will impair the automatic performance. This arrangement will be described in greater detail later.

The lower keyboard key-on memory 47 selectively stores key-on signal KO corresponding to the lower keyboard exclusive channel among key-on signal KO stored in the key-on memory 46 when any key in the lower keyboard has newly been depressed. The output of the OR gate 65 (key-on signal KO) is applied to an AND gate 83 via a line 82. Accordingly, when the key-on signal KO is loaded in the key-on memory 46, the AND gate 83 is enabled.

Applied to the other input terminal of the AND circuit 83 is a lower keyboard new key-on signal LNK representing the fact that a key is newly depressed in the lower keyboard. The aforementioned output of the OR circuit 57 and the key code detection signal KON are applied to an AND circuit 84, and the lower keyboard signal L and the lower keyboard exclusive channel signal YLK 2 in the second process period are applied to the remaining input terminals of the AND circuit 84. Accordingly, if a key is depressed in the lower keyboard, at the beginning of the depression the output LNK of the AND circuit 84 is raised to "1" only once in synchronization with the lower keyboard exclusive channel time of the second process period. In this operation, the OR circuit 65 outputs a signal "1" in synchronization with the assignment channel of the tone of a key being depressed in the lower keyboard. Therefore, the output of the AND circuit 83 is raised to "1" in synchronization with the assignment channel of the tone of the key being depressed in the lower keyboard. This output "1" is applied through an OR circuit 85 to the lower keyboard key-on memory 47 where it is stored. The signal LKO thus stored in the memory 47 is self-held by means of the AND circuit 86 and the OR circuit 85. The output of the NOR circuit 87 is applied to the AND circuit 86. The AND circuit is disabled when the initial clear signal Ic is provided or in channel times other than the lower keyboard exclusive channel (the signal $\overline{YLK}$ being at "1") or when the AND circuit 84 provides the lower keyboard new key-on signal LNK. Applied to the other input terminal of the AND circuit 86 is a lower keyboard key depression memory signal LKM whose level is maintained raised to "1" when a key is depressed in the lower keyboard. Therefore, when a key is depressed in the lower keyboard, the self-holding of the lower keyboard key-on memory 47 is permitted. Alternatively stated, if any key is kept depressed in the lower keyboard, storage in the lower keyboard key-on memory 47 concerning a released key in the lower keyboard is not cancelled whereby the lower keyboard key-on signal LKO is generated as if the (released) key was kept depressed. If, however, any key is newly depressed in the lower keyboard, the lower keyboard new key-on signal LNK is generated so that the storage in the lower keyboard key-on memory 47 is rewritten. That is to say, the key-on signal KO of the lower keyboard in the key-on memory 46 is transferred to the memory 47 and the lower keyboard key-on signal LKO is stored in correspondence to the lower keyboard exclusive channel for the key which is actually being depressed.

Generation of lower keyboard key depression memory signal LKM

The lower keyboard key depression memory signal LKM can be produced by selectively storing a key-on signal KO corresponding to the lower keyboard exclusive channel from among key-on signals KO outputted from the key-on memory 46 in a time division manner. An AND gate 113 receives at one input a lower keyboard exclusive channel signal YLK and is enabled only at the lower keyboard exclusive channel time (FIG. 4(c)). To the other input of the AND gate 113 is applied the key-on signal KO so that the key-on signal KO concerning the lower keyboard only is selected by this AND gate 113 and applied to a delay flip-flop 115 via an OR gate 114. The output of the delay flip-flop 115 is self-held via an AND gate 116. The AND gate 116 is disabled by an output "0" of a NOR gate 117 which receives the initial clear signal IC and a final channel signal $C_{16}$. The final channel signal $C_{16}$ is a signal outputted repeatedly from the AND gate 25 shown in FIG. 5 in synchronism with the final channel time in the time division time slot train, i.e., the time slot for the sixteenth channel (FIG. 4(n)). Accordingly, the AND gate 116 is disabled at the sixteenth channel time at which the final channel signal $C_{16}$ and self-holding of the delay flip-flop 115 is cancelled.

The output of the delay flip-flop 115 is applied to an AND gate 118 which is enabled by the final channel signal $C_{16}$. Accordingly, the stored data in the delay flip-flop 115 is loaded in a delay flip-flop 120 via an AND gate 118 and an OR gate 119 immediately before the cancellation of self-holding of the delay flip-flop 115. The output of the delay flip-flop 120 is self-held via an AND gate 121 and an OR gate 119. The AND gate 121 is disabled by the output "0" at the NOR gate 117. Accordingly, self-holding of the delay flip-flop 120 is is cancelled every sixteenth channel time at which the final channel signal $C_{16}$ is generated. If a signal "1" is given by the delay flip-flop 115 at the time slot for the sixteenth channel time, the signal "1" is stored in the delay flip-flop 120 and self-held therein until generation of a next final channel signal $C_{16}$. Consequently, if any key is kept depressed in the lower keyboard (i.e. if any tone is kept assigned to the lower keyboard exclusive channel), The output of the delay flip-flop 120 remains to be "1" in a direct current manner. This output "1" of the delay flip-flop 120 is used as the lower keyboard key depression memory signal LKM.

(Key-off Detection)

The load signal LD representing a channel to which a newly depressed key is to be assigned is applied from the OR circuit 64 through a line 88 (FIG. 7) to an OR circuit 89, and it is stored in the key-on temporary memory 48. The key-on temporary memory 48 operates in such a manner that, if a key is depressed even once in one generation period of the key-off inspection signal X, the memory 48 stores a signal "1" in the assignment channel of the key. This storage is self-held by means of an AND circuit 90. Upon application of the key-off inspection signal X by the key coder 11, the AND circuit 90 is disabled. Accordingly, whenever the key-off inspection signal X is supplied, the storage in the key-on temporary memory 48 is cleared. The key-off inspection signal x is applied to an AND circuit 107, in FIG. 7, and it is selected only for the first process period (the part (f) of FIG. 4) with the aid of the signal H1. A key-off inspection singal X1 selected in synchronization with the first process period is applied through an inverter 91 to the AND circuit 90, as a result of which the AND circuit 90 is disabled only for the first process period. During this period, the contents stored in all the channels in the key-on temporary memory 48 are cleared.

In the case where a key code $N_1$-$B_3$ (or $AN_1$-$AB_2$) based on the depression of a new key which is not subjected to assignment is supplied, the aforementioned load signal LD is applied through the line 88 and the OR circuit 89 to the key-on temporary memory 48, and a signal "1" is stored in the memory 48 is synchronization with the channel time to which the relevant key code $N_1$-$B_3$(or $AN_1$-$AB_2$) has been assigned. If, in the case where an already assigned key is depressed, the key code $N_1$-$B_3$ of that key is supplied, an assigned key-on signal AKON is provided by an AND circuit (FIG. 7) in synchronization with that assignment channel and it is applied through a line 92 to an AND circuit 93. A second process period synchronization signal YH2 is applied to the other input terminal of the AND circuit 93. Therefore, the assigned key-on signal AKON apasses through the AND circuit 93 only for the second process period, and it is applied through an OR circuit 89 to the key-on temporary memory 48, where it is stored. Accordingly, the storage in the key-on temporary memory 48 is cleared by the key-off inspection signal X once; however, as long as the key is depressed, a signal "1" is stored in that key's assignment channel before the next key-off inspection signal X is supplied. The second process period synchronization signal YH2 mentioned above is supplied by an AND circuit 108 in FIG. 5., and it is produced in accordance with the AND logic of the output of an OR circuit 109 (FIG. 5) receiving the outputs of the sixteen stages in the shift register 26 (FIG. 5) and the second process period H2 of the decoder 30 (FIG. 5). Accordingly, the signal YH2 is correctly in synchronization with the first through sixteenth channel times in the second process period.

The key-off inspection signal X generation period is of the order of 5 ms. If the key code $N_1$-$B_3$ of the key which was depressed is not supplied by the key coder 11 during one generation period of the signal X at all it is determined that the key has been released. This determination is carried out by an AND circuit 95. That is, it can be determined as follows: Key depression is being effected for the channel for which a signal "1" is stored in the key-on temporary memory 48 immediately before the key-off inspection signal X is supplied, and key release has been effected for the channel for which a signal "0" is stored therein. Thus, the output of the key-on temporary memory 48 is applied through an inverter 94 to the AND circuit 95, thereby to enable the latter 95 during the channel time for which the key release is effected. A key-off inspection signal X1 having a 16-bit time width in synchronization with the first process period is applied to the AND circuit 95 from an AND circuit 107. Furthermore, the key-on signal KO outputted by the key-on memory 46 is also applied to the AND circuit 95 in order to detect whether or not a key has been depressed in the channel for which the memory content is "0" in the key-on temporary memory 48. Therefore, only when the key which has been depressed is released, that is, key release is effected, the AND condition of the AND circuit 95 is satisfied in the assignment channel time of that key. The output "1" of this AND circuit 95 is a key-off signal KOF.

The key-off signal KOF is applied through an AND circuit 96 and an OR circuit 97 to an inverter 98, thereby to disable the self-holding AND circuit 81 of the key-on memory 46. As a result, the key-on signal KO stored in the key-on memory 46 is cleared in correspondence to the channel for which the key-off signal KOF is provided. Accordingly, the key-on signal KO is stored in the key-on memory 46 only for the period during which a key is being depressed. Since the key code memory circuit 17 is not cleared by the key-off signal KOF, the relevant channel assignment is maintained even after the key release, and the key code $N_1$*-$B_3$* concerning the key released is remains stored.

The key-off signal KOF is applied through an OR circuit 99 to the key-off memory 49. This key-off memory 99 operates to store a signal "1" in synchronization with the assignment channel time of a key which has been released among keys which are being assigned to the channels. A key-off memory signal KOFM outputted by the last stage therein is self-held by means of an AND circuit 100 and the OR circuit 99. Applied to the other input teminal of the AND circuit 100 is the output of the OR circuit 64 which are delivered through the line 88 and inverter 101. Therefore, if the load signal LD is provided during a channel time and a new assignment is effected, the storage in that channel of the key-off memory 49 is cleared. The key-off memory signal KOFM is applied through an inverter 102 to one input terminal of an AND circuit 103, to the other input terminal of which the key-off signal KOF is applied. When the key-off signal KOF is provided in a channel for the first time, the storage in that channel of the key-off memory 49 is "0". The output of the inverter 102 to which the signal KOFM is applied is "1" and therefore the output of the AND circuit 103 has "1". This output "1" of the AND circuit 103 is utilized as a new key-off signal NKF representative of the fact that key release has effected. The new key-off signal NKF is produced only once in the channel time to which the relevant key has been assigned at the beginning of the key release, Memory function The AND circuit 96 to which the key-off signal KOF is applied, is normally enabled; however, when "a memory function" is effected, it is disabled during the lower keyboard exclusive channel time. Upon operation of a switch (not shown) for performing the memory function, a memory signal MM is provided by the key coder 11 and it is applied to one input terminal of an AND circuit 104 (FIG. 7) to the other input terminal of which the lower keyboard exclusive channel signal YLK is applied. The output of the AND circuit 104 is applied through an inverter 105 to the AND circuit 96. Accordingly, where the "memory function" is performed, the AND circuit 96 is disabled during the lower keyboard exclusive channel time (cf. the part (c) of FIG. 4). Even if the key-off signal KOF is produced in these channel times, the self-holding AND circuit 81 of the key-on memory 46 is not disabled. Accordingly, in practice, even if a key is released in the lower keyboard, the key-on signal of the key-on memory 46 is not cleared, and it is handled as if the key in the lower keyboard were continuously depressed. Thus, the tone concerning the key is produced even after it is released, the above-described "memory function" is advantageous in improving the automatic performance effect. Furthermore, since the embodiment is so designed that the lower keyboard exclusive channel can be used for automatic chord, automatic chords can be produced even after key release. Further, since the automatic arpeggio tone is formed in accordance with a tone which has already been assigned in the lower keyboard channel (i.e. a tone of a key actually depressed in the lower keyboard or an automatic chord tone), automatic arpeggio tones can be produced even after key release.

The output of the AND circuit 104 is applied also to an AND circuit 106. The key-on signal KO of the key-on memory 46 which has been held even after the key release owing to the "memory function" is cleared in correlation to the output "1" of the AND circuit 106. A signal obtained by inverting the output of the key-on temporary memory 48 with an inverter 94 and the output of the AND circuit 84 are applied to the remaining input terminal of the AND circuit 106. The output of the inverter 94 is raised to "1" in a channel for which key release is effected. If this channel is the lower keyboard exclusive channel, then the output of the AND circuit 104 is also raised to "1". Therefore, the AND circuit 106 is enabled in the relevant channel time. If, in this case, the AND circuit 84 produces the lower keyboard new key-on signal LNK, the output of the AND circuit 106 is raised to "1". The output "1" of the AND circuit 106 is applied through the OR circuit 97 and the inverter 98 to the AND circuit 81 to disable the latter 81, as a result of which the storage of the relevant channel of the key-on memory 46 is cleared. Accordingly, the key-on signal KO held even after key release on account of the "memory function" is cleared when a key is newly depressed in the lower keyboard (or when the lower keyboard new key-on signal LNK is provided).

Generation of key-on again signal KAG

In the case where, immediately after a key is released, and the same key is depressed again, a key-on again signal KAG is outputted from the AND circuit 44, and the assignment of the key is effected to a channel different from the channel to which the key was assigned. The comparison output EQ from the key code comparison circuit 18 is applied through the line 42 to the AND circuit 44, and furthermore the key code detection signal KON representative of the supply of key code $N_1$-$B_3$ (or $AN_1$-$AB_2$) and the output signal of the key-off memory 49 are applied to the AND circuit 44. Accordingly, under the conditions that the key code $N_1$-$B_3$ (or $AN_1$-$AB_2$) being supplied new is equal (in keyboard also) to a key code $N_1$*-$B_3$* assigned to a channel, and the storage of the key-off memory 49 in the channel to which that key code $N_1$*-$B_3$* has been assigned is "1" (that is, the key concerning the key code $N_1$*-$B_3$* which has provided coincidence is released), a signal "1" is outputted by the AND circuit 44. This output "1" of the AND circuit 44 is applied, as the key-on again signal KAG representative of the fact that a key released is depressed again immediately, to the OR circuit 110, and it is further applied through an AND circuit 111 to a delay flip-flop 112 where it is stored. The output of the delay flip-flop 112 is applied to the OR circuit 57, and it is utilized for generating the new key-on signal KON.

The operation of the tone production assignment circuit 13 has been described above. Key codes $N_1$*-$B_3$* assigned to the respective channels are repeatedly outputted by the key code memory circuit 17 in a time division manner and supplied to the musical tone generator 16. The key-on signal KO repeatedly outputted in time division by the key-on memory 46 in association with the respective channel times are also supplied to the musical tone generator 16. The musical tone generator 16 generates, in response to the key codes $N_1$*-$B_3$* and the key-on signal KO, musical tone signals of tones assigned to the respective channels.

Since a musical tone generation system in which musical tone signals assigned to time shared tone production channels are generated in a time division manner is already known (e.g. U.S. Pat. No. 3,882,751), the musical tone generator 16 may be composed of such known system. Alternatively, a plurality of musical tone generation systems may be provided in parallel in correspondence to respective tone production channels and the time division key code $N_1$*-$B_3$* and key-on signal KO may be distributed to the respective channels with respect to each of the musical tone generation system so that musical tone signals of the respective channels will be generated in a static state.

(5) Description of Automatic Arpeggio Circuit 14

Figure 8:
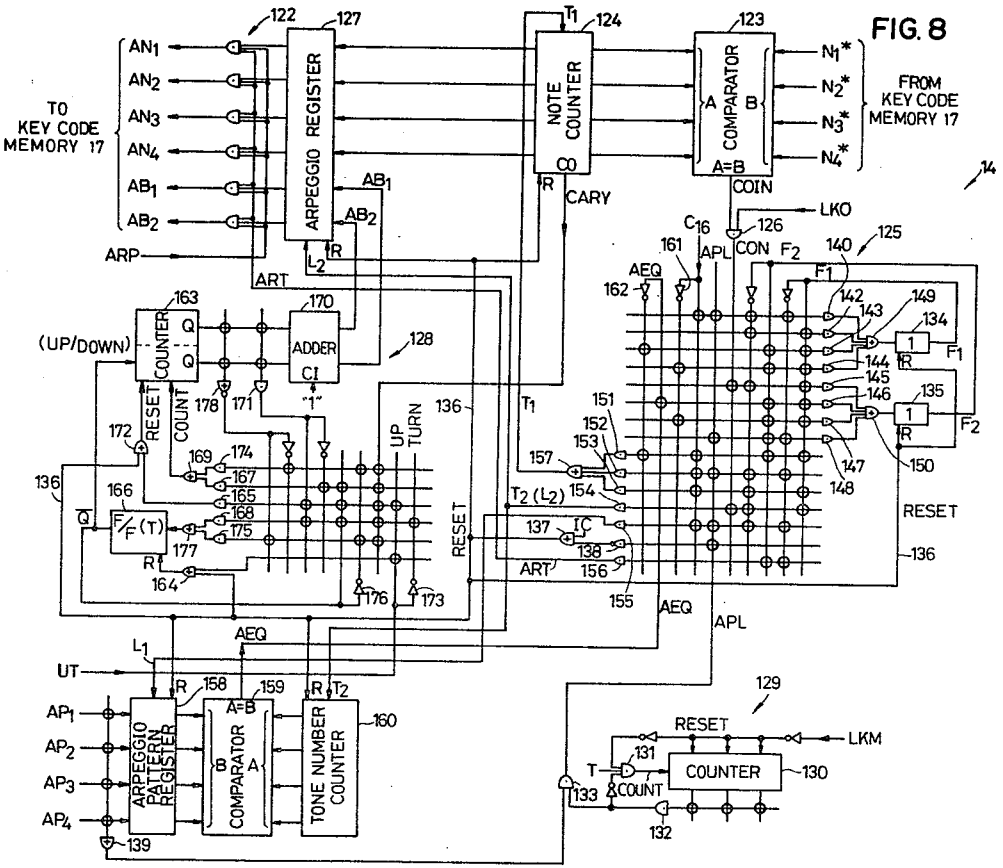
FIG. 8 is a circuit diagram showing an example of the automatic arpeggio circuit shown in FIG. 2 in detail.

One detailed example of the automatic arpeggio circuit 14 is as shown in FIG. 8. Among the key codes $N_1$*-$B_3$* stored in the channels of the key code Memory circuit 17, the note codes $N_1$*-$N_4$* are applied to the automatic arpeggio circuit 14. Among these note codes $N_1$*-$N_4$*, the note codes $N_1$*-$N_4$* corresponding to a plurality of keys depressed in a particular keyboard (for instance the lower keyboard) (being generated in the 2nd, 5th, 8th, 9th, 11th, 12th and 15th channel times) are successively selected in accordance with the arpeggio pattern, and the octave information according to the arpeggio pattern is given to the note codes $N_1$*-$N_4$* thus selected (the block code $AB_1$, $AB_2$ being given thereto), so that the key code $AN_1$-$AB_2$ of the automatic arpeggio tone is provided. The key code $AN_1$-$AB_2$ thus provided is selected by an AND circuit group 122 for the period (48 μs) during which the automatic arpeggio signal ARP is supplied by the above-described key coder 11, and it is delivered to the key code memory circuit 17 (the OR circuit group 36 in FIG. 6) as if the key corresponding to the key code $AN_1$-$AB_2$ were depressed. Then, the key code is stored in the arpeggio-only-channel (the 14th channel) of the key code memory circuit 17.

Selection of the note codes $N_1$*-$N_4$* for the tones assigned to the lower-keyboard-only-channel is carried out by utilizing a comparator 123. In the comparator 123, the note code $N_1$*-$N_4$ applied from the key code memory circuit 17 is compared with a 4-bit binary counter (note counter) 124, and a coincidence signal COIN is outputted when both are coincident with each other. The counter 124 is controlled by a state control logic 125 to carry out the up-count operation. The coincidence signal COIN outputted by the comparator 123 is applied to an AND circuit 126, whereby the coincidence signal COIN provided with respect to the lower-keyboard exclusive channel is selected with the aid of the lower keyboard key-on signal LKO supplied from the lower keyboard key-on memory 47. The coincidence signal concerning the lower keyboard exclusive channel which is selected by the AND circuit 126 will be referred to as "a coincidence signal CON" hereinafter, when applicable.

The count value of the note counter 124 obtained when the coincidence signal CON is provided is inputted into a register (or an arpeggio register) 127, into which the block code $AB_1$, $AB_2$ formed by an octave control section 128 is inputted simultaneously. The data written in the register 127 are not immediately provided as the automatic arpeggio tone key code $AN_1$-$AB_2$; that is, only the data specified by the state control logic 125 is provided as the automatic arpeggio tone key code $AN_1$-$AB_2$.

The state control logic 125 is provided with two delay flip-flops 134 and 135. The operations of various circuits in the automatic arpeggio circuit 14 are controlled by the signals ($F_1$ and $F_2$) of the delay flip-flops 124 and 135.

*Description of the Arpeggio Pattern

An arpeggio pattern to be performed is specified by the arpeggio pattern signal $AP_1$-$AP_4$ outputted by the pattern generator 21 (FIG. 2). The arpeggio pattern signal $AP_1$-$AP_4$ is timewise alignment of 4-bit numerial data. These numerical values respectively specify the positions (locations) of the tones to be produced for arpeggio by the location numbers counted from the note having the lowest note pitch among the depressed keys in the lower keyboard as viewed only from notes and not from octave. The term "note pitch" as used herein is not the absolute tone pitch, but it is intended to mean a relative tone pitch between twelve notes assuming an octave. As indicated in Table 1, in the note code $N_1$-$N_4$, the minimum value is assigned to the note C# and the maximum value is assigned to the note C. Accordingly, in this example, the note C# has the lowest pitch, and the tone pitches increase in the order of the notes D, D#, . . . and B, and finally the note C has the highest tone pitch, irrespective of their belonging octaves.

One example of the generation of an arpeggio pattern signal $AP_1$-$AP_4$ in an arpeggio pattern is as illustrated in FIG. 9. The generation time width of the arpeggio pattern signal $AP_1$-$AP_4$ corresponds to the generation time width of an automatic arpeggio tone, being approximately 10 ms or more. This time width may be considered as the time during which a key is depressed in manual arpeggio performance. The generation interval of the arpeggio signal $AP_1$-$AP_4$ corresponds to the length of a musical note in automatic arpeggio.

In an example shown in the part (a) of FIG. 9, the first instant value of the arpeggio pattern sigal $AP_4$, $AP_3$, $AP_2$, $AP_1$ is "0 0 0 1". This is "1" in decimal number, and specifies that the first note from the lowest note (that is, the lowest note) among the notes of the keys depressed in the lower keyboard is to be produced as an automatic arpeggio tone. The second instant value of the arpeggio pattern signal $AP_4$-$AP_1$ is "0 0 1 0" which is "2" in decimal number and specifies that the second note from the lowest note among the notes of the keys depressed in the lower keyboard is to be produced as an automatic arpeggio tone. As is apparent from the above description, the arpeggio pattern signal $AP_1$-$AP_4$ designates the timings of producing an automatic arpeggio tones and the location order (position) in pitch of the notes of the keys depressed in the lower keyboard.

The arpeggio pattern signal $AP_1$-$AP_4$, as a result, includes te octave informations of the automatic arpeggio tones indirectly. The part (b) of FIG. 9 indicates one example of the generation of the arpeggio pattern signal $AP_1$-$AP_4$ whose instantaneous values are expressed by decimal numbers. If it is assumed that the part (b) of FIG. 9 shows one phrase arpeggio pattern, the arpeggio pattern signals $AP_1$-$AP_4$ are repeatedly provided in this order. If three keys are depressed in the lower keyboard, selection of all of the depressed keys is completed when the key for the third tone is selected. In this case, the arpeggio tones for the 4th, 5th 6th and 7th tones are obtained by successively increasing the octaves of the three arpeggio constituent notes (the notes of the keys depressed in the lower keyboard). That is, when the numerical value of an arpeggio pattern signal $AP_1$-$AP_4$ is larger than the total number of the arpeggio constituents (the depressed keys), the octave range is shifted higher. The arpeggio pattern signal $AP_1$-$AP_4$ does not have the octave information predeterminedly, that is, the octave information is given thereto as a result (in relation with the number of depressed keys). The part (c) of FIG. 9 illustrates arpeggio notes which, when three keys for notes E, G and B are depressed, are produced in accordance with the pattern shown in the part (b) of FIG. 9. The part (d) of FIG. 9 illustrates arpeggio notes which, when six keys D, E, F, G, A and B are depressed, are produced in accordance with the order pattern shown in the part (b) of FIG. 9. With the same arpeggio pattern being used, the arpeggio is performed within the range of three octaves in the case of the part (c) of FIG. 9, while it is performed within the range of two octaves in the case of the part (d) of FIG. 9. This octave control is carried out by the octave control sector 128.

* Description of a Waiting Time Setting Circuit 129

The automatic arpeggio constituents are prepared by assigning keys depressed in the lower keyboard to the lower keyboard exclusive channels, whereby the automatic arpeggio tones are produced. However, if the automatic arpeggio circuit 14 is operated before all of the desired keys are depressed, an unintentional tone is produced as an arpeggio tone. For instance, if the automatic arpeggio circuit 14 is operated before the key for the first tone in the arpeggio tone is depressed, then the second tone is produced as the first tone, as a result of which the arpeggio performance is started in an eccentric manner. This is due to the fact that the key depression by a person is fluctuated, and the automatic arpeggio circuit 14 operating in a matter of one $\mu$s responds to this fluctuation. In order to overcome this inconvenience, a waiting time setting circuit 129 is provided so that the automatic arpeggio circuit 14 is not operated in the initial key depression.

A lower keyboard key depression memory signal LKM from the delay flip-flop 120 in FIG. 7 is applied to the waiting time setting circuit 129, and when no key is depressed in the lower keyboard, a 3-bit binary counter 130 is in reset state. Upon depression of any key in the lower keyboard, the signal LKM is raised to "1", as a result of which the reset state of the counter 130 is released and an AND circuit 131 is enabled. Therefore, the count pulse T is applied through the AND circuit 131 to the counter 130, where it is counted. When seven pulses T. are applied to the counter 130, the output of the counter 130 becomes "111", and an AND circuit 132 outputs a signal "1". As a result, the AND circuit 131 is disabled, and the counter 130 holds its output "1 1 1". When the output of the AND circuit 132 is raised to "1", an AND circuit 133 is enabled.

During the period of time corresponding to seven pulses T after the initial key depression in the lower keyboard, for instance 5–10 ms, the output of the AND circuit 133 is set to "0". When the output signal APL of the AND circuit 133 is at "0", the state control logic 125 is not operated, and therefore the automatic arpeggio circuit 14 is not operated. During this period of time, the keys in the lower keyboard depressed substantially simultaneously but with fluctuation are assigned to the respective tone production channels. Accordingly, after all of the tones required for the automatic arpeggio performance have been assigned to the lower keyboard exclusive channels, the automatic arpeggio circuit becomes operable.

* Description of the State Control Logic 125

The signals ($F_1$ and $F_2$) of the delay flip-flops 134 and 135 in the state control logic 125 has four states.

(1) Standby state $ST_0$

If the signal $F_1$, $F_2$ is "0 0", it means the standby state $ST_0$. In this case, the counters and memories in the automatic arpeggio circuit 14 are reset to standby state. For instance when the power switch is turned on, the initial clear signal IC is applied through an OR circuit 137 to a reset line 136, whereby the delay flip-flops 134 and 135 and other counters and memories are reset. When no key is depressed in the lower keyboard, the output signal APL of the AND circuit 133 is at "0", and therefore a reset signal "1" is applied to the reset line 136 via a NAND circuit 138 and the OR circuit 137. Thus, at the beginning, the signal $F_1$, $F_2$ is set to "0 0" (standby state $ST_0$).

Figure 10:
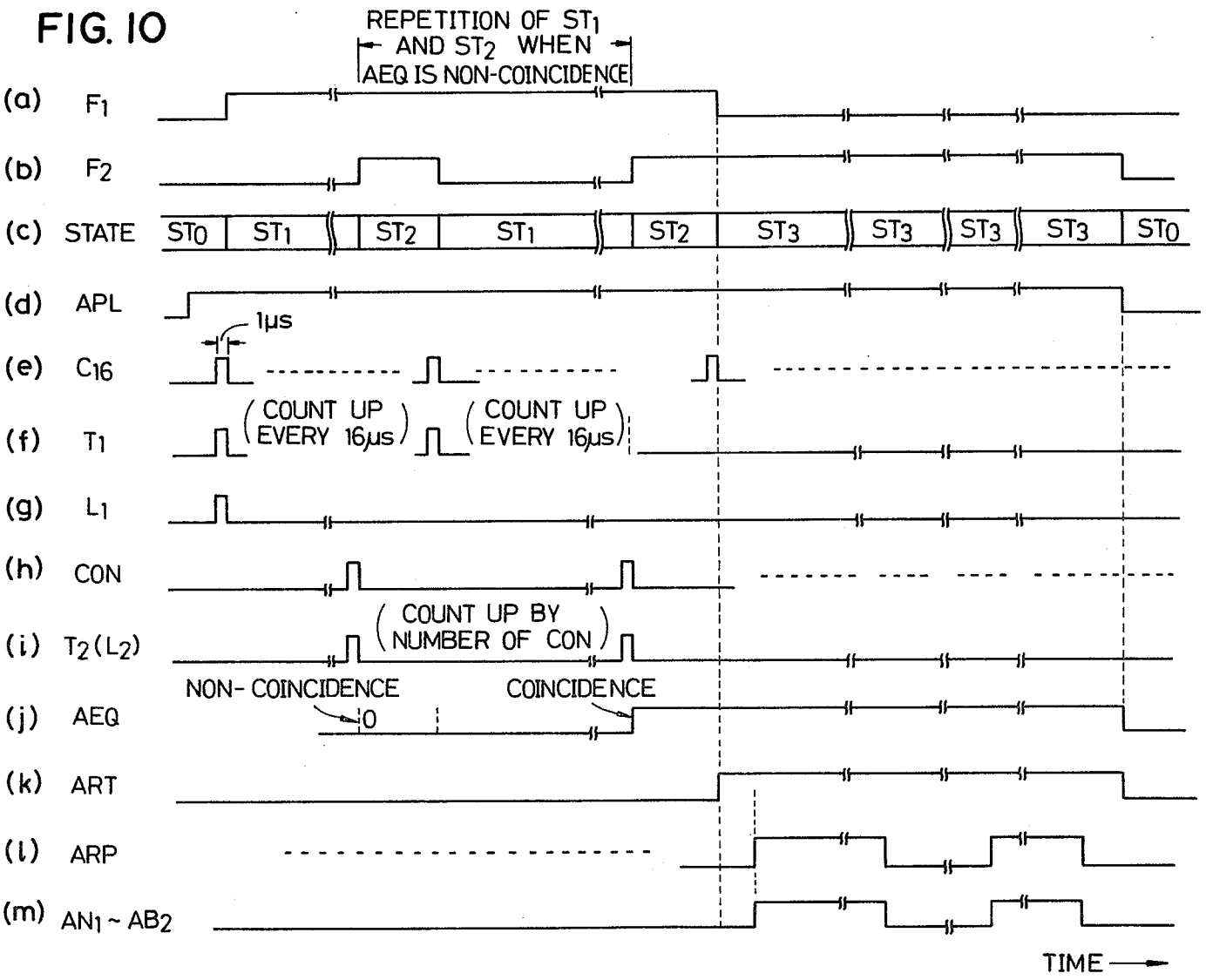
FIGS. 10(*a*) to 10(*m*) are time charts illustrative of an example of operation of the state control logic shown in FIG. 8.

The states of the signals $F_1$ and $F_2$ are as shown in the parts (a) and (b) of FIG. 10, for instance, and state numes corresponding to these states are as indicated in the part (c) of FIG. 10.

After the waiting time provided by the above-described waiting time setting circuit 129 is over (the AND circuit 133 having been abled) upon application of the arpeggio pattern signal $AP_1$-$AP_4$ the output of an OR circuit 139 is raised to "1", and the output signal APL of the AND circuit 133 is set to "1". Accordingly, the signal APL (hereinafter referred to as "an arpeggio tone production timing signal" when applicable) is maintained at "1" while one arpeggio pattern signal is being supplied (cf. FIG. 9, (*a*)). When the arpeggio tone production timing signal APL is at "1", the output of the NAND circuit 138 is set to "0", and the reset signal on the reset line is set to "0". Accordingly, when the arpeggio pattern signal $AP_1$-$AP_4$ is supplied, that is, one arpeggio tone should be produced, the automatic arpeggio circuit 14 becomes operable.

In the standby state $ST_0$, when the arpeggio tone production timing signal APL is provided (cf. FIG. 10, (*d*)) and the signal $C_{16}$ with a time width 1 μs which is produced with a period of 16 μs as shown in the part (n) of FIG. 4 is provided (cf. FIG. 10, (*e*)), the condition of an AND circuit 140 in the state control logic 125 is satisfied, and therefore a signal "1" is inputted through an OR circuit 149 to the delay flip-flop 134. Simultaneously, the condition of an AND circuit 152 is satisfied, as a result of which the count pulse $T_1$ is produced via an OR circuit 157 (cf. FIG. 10, (*f*)), and the count value of the note counter 124 is increased by one count. At the same time, the condition of an AND circuit 155 is satisfied, and the load signal $L_1$ is applied to an arpeggio pattern register 158 (cf. FIG. 10, (*g*)). As a result, the arpeggio pattern signal $AP_1$-$AP_4$ is stored in the arpeggio pattern register 158. One microsecond after this, the signal $F_1$ is raised to "1", and the standby state is shifted to the first state $ST_1$ described below.

(2) First State $ST_1$

When the signal $F_1$, $F_2$ is "1 0", it is referred to as the first state $ST_1$. In the first state $ST_1$, the condition of an AND circuit is satisfied whenever the signal $C_{16}$ is provided, and the count pulse $T_1$ is applied through the OR circuit 157 to the note counter 124. In the first state $ST_1$, the condition of an AND circuit 142 is satisfied at all times, and the memory signal "1" of the delay flip-flop 134 is maintained held. Accordingly, the signal $F_1$, $F_2$ is maintained at "1 0", and the first state $ST_1$ is maintained.

In the first state $ST_1$, the note counter 124 counts up every 16 μs with the timing of the signal $C_{16}$, and the count value of the counter 124 is compared with the note code $N_1$*-$N_4$* supplied in time division manner from the key code memory circuit 17, in the comparator 123. With respect to the note code $N_1$*-$N_4$*, as the data of each channel (sixteen channels in total) appears every one microsecond, comparison with the note codes $N_1$*-$N_4$* of all the channels is effected for 16 μs during which the count value of the note counter 124 is maintained unchanged. When the note code $N_1$*-$N_4$* for the lower keyboard tone coincides with the count value of the note counter 124, the coincidence signal CON is provided via the AND circuit 126 (FIG. 10, (h) and is applied to the note control logic 125.

As the note counter 124 counts up from "0 0 0 0", the coincidence signals CON are provided successively starting from the low tone side note code $N_1$*-$N_4$* (first note). When one coincidence signal CON is produced, the condition of an AND circuit 145 is satisfied, and therefore a signal "1" is inputted through an OR circuit into the delay flip-flop 135. Simultaneously, the condition of an AND circuit 154 is satisfied, as a result of which the count pulse $T_2$ is supplied to a 4-bit binary counter (the tone number counter) 160 and the load signal $L_2$ is supplied to the arpeggio register 127 (FIG. 10, (*i*)). As a result, the counter 160 counts up by one count, while the count value of the note counter 124 which is equal to the note code $N_1$*-$N_4$* causing the coincidence, and the block code $AB_1$, $AB_2$ from the octave control section 128 are inputted into the arpeggio register 127. The count value of the tone number (quantity) counter 160 represents the location order of the tones from the lowest, which corresponds to the key code $AN_1$-$AB_2$ stored in the arpeggio register 127. One microsecond (1 μs) after this, the output $F_2$ of the delay flip-flop 135 is set to "1". In this connection, as the signal $F_1$ is maintained at "1" by means of the AND circuit 142, the signal $F_1$, $F_2$ becomes "1 1". Thus, the first stage is shifted to the second stage $ST_2$ described below.

As is clear from the above described, in the first state $ST_1$, the note counter 124 counts up until one coincidence signal CON is produced, and the resulting count value thereof is compared with the note code $N_1$*-$N_4$*.

(3) The Second State $ST_2$

When the signal $F_1$, $F_2$ is "1 1", it is referred to as the second state $ST_2$. In the second state $ST_2$, the arpeggio pattern signal $AP_1$-$AP_4$ stored in the arpeggio pattern register 158 is compared with the count value of the tone number counter 160 in a comparator 159. When both coincide with each other, the comparator 159 output a coincidence signal AEQ. The provision of the coincidence signal AEQ means that the key code $AN_1$-$AB_2$ stored in the arpeggio register 127 is for the note having the order specified by the arpeggio pattern signal $AP_1$-$AP_4$.

The second state $ST_2$ is held until the next timing signal $C_{16}$ is provided through AND circuits 144 and 147. That is, a signal $\overline{C_{16}}$ obtained by inverting the signal $C_{16}$ by an inverter 161 and the signals $F_1$ and $F_2$ are applied to the AND circuits 144 and 147, and in the second state $ST_2$ ($F_1$, $F_2$ being "1 1") the conditions of the AND circuits 144 and 147 are maintained satisfied immediately before the signal $C_{16}$ is provided. The outputs of the AND circuits 144 and 147 are applied to the delay flip-flops 134 and 135.

First, the case where the count value of the counter 160 is not coincident with the value of the arpeggio pattern signal $AP_1$-$AP_4$, will be described. In this case, the coincidence signal AEQ is at "0" (cf. FIG. 10, (*j*)) in the second state. A signal $\overline{AEQ}$ obtained by inverting the signal AEQ by an inverter 162 is at "1", and the condition of the AND circuit 143 is established. And the condition of an AND circuit 151 is satisfied with the timing of the signal $C_{16}$. Accordingly, at the timing of the signal $C_{16}$, a signal "1" is applied only to the delay flip-flop 134 through an AND circuit 143, and one microsecond (1 μs) thereafter the signal $F_1$ is raised to "1" while the signal $F_2$ is set to "0". At the same time, the count pulse $T_1$ is applied to the note counter 124 through the AND circuit 151 and the OR circuit 157. Therefore, the second state is shifted back to the above-described first state $ST_1$. A single coincidence signal CON is produced in the first state $ST_1$, the first state $ST_1$ is shifted to the second state $ST_2$ again, and the same process is carried out. Until the coincidence signal AEQ is produced, the first state and the second state are alternately effected, and the count value of the tone number counter is increased whenever the coincidence signal is produced.

When the count value of the tone number counter 160 coincides with the value of the arpeggio pattern signal, the comparator 159 outputs the coincidence signal AEQ in the second state $ST_2$ (cf. FIG. 10, (*j*)). Accordingly, the condition of an AND circuit 146 is satisfied, and a signal "1" is applied only to the delay flip-flop 135 through the AND circuit 146 with the timing of the signal $C_{16}$ (with the timing of the end of the second state $ST_2$). Therefore, one microsecond (1 μs) thereafter, the signal $F_1$, $F_2$ become "0 1". Thus, the second state is shifted to the third state $ST_3$ described below.

(4) The Third State $ST_3$

When the signal $F_1$, $F_2$ is "0 1", the third state $ST_3$ is effected. In the third state, the condition of an AND circuit 156 is satisfied and an arpeggio tone key code generation signal ART is produced (FIG. 10, (*k*)). In the third state $ST_3$, as long as the arpeggio tone production timing signal APL is produced, the condition of an AND circuit 148 is satisfied, and the storage ($F_2$="1") of the delay flip-flop circuit 135 is held. Accordingly, for the period of time during which one value of the arpeggio pattern signal $AP_1$-$AP_4$ is supplied, the third state $ST_3$ is maintained, and the arpeggio tone key code generation signal ART is continuously produced.

The arpeggio tone key code generation signal ART is applied to the AND circuit group 122 to enable each AND circuit in this group. The AND circuit group 122 in a gate circuit supplies the key code $AN_1$-$AB_2$ stored in the arpeggio register 127 to the key code memory circuit 17. In this connection, the key code $AN_1$-$AB_2$ of an automatic arpeggio tone specified by the arpeggio pattern signal $AP_1$-$AP_4$ has been stored in the arpeggio register 127.

The automatic arpeggio selection signal ARP is applied to the remaining input terminals of the AND circuit group 122 (FIG. 10(*l*)). The key code $AN_1$-$AB_2$ of an arpeggio tone which has been made produceable with the aid of the arpeggio tone by code generation signal ART is supplied to the key code memory circuit 17 for 48 μs with the timing of this automatic arpeggio selection signal ARP (FIG. 10, (*m*)). As was described before, the automatic arpeggio selection signal ARP is repeatedly produced by the key coder 11 at time intervals of the order of 1 ms–5 ms. Therefore, the automatic arpeggio selection signal ARP is produced once through several times while the arpeggio tone key coder generation signal ART is being produced.

When one arpeggio pattern signal $AP_1$-$AP_4$ disappears—the timing of generation of one arpeggio pattern signal is ended—the arpeggio tone production timing signal APL is set to "0", and the third state $ST_3$ is ended. As the signal APL is set to "0", the output of the NAND circuit 138 is raised to "1" and the reset signal is applied to the reset line 136. As a result, the delay flip-flops 134 and 135, the note counter 124, the arpeggio register 127, the arpeggio pattern register 158, the tone number counter 160, and the counter 163 in the octave control section 128 are reset. Thus, the state is returned to the standby state $ST_0$.

One tone of the automatic arpeggio tone is produced as was described above. When the next arpeggio pattern signal $AP_1$-$AP_4$ is supplied, the key code $AN_1$-$AB_2$ of the automatic arpeggio tone is produced similarly as in the above-described case.

* Description of the Octave Control Section 128

The octave range of the automatic arpeggio tone is changed whenever a carry signal CARY is produced by the note counter 124. The 4-bit note counter 124 counts up from "0". If the count pulse $T_1$ is supplied to the counter 124 when the count value thereof reaches the maximum value "1 1 1 1", the counter 124 output the carry signal CARY, and the count value of the counter 124 is restored to "0 0 0 0" again. The fact that the note counter 124 has completed one cycle of its counting operation means that the note codes $N_1$*-$N_4$* of keys depressed in the lower keyboard have been detected (or one set of coincidence signals CON have been produced for these note codes $N_1$*-$N_4$*). When no coincidence signal AEQ is produced by the comparator 159 after the note codes $N_1$*-$N_4$* for the key depressed have been detected, or when the number of coincidence signal CON detections does not reach the number of tones specified by the arpeggio pattern signal $AP_1$-$AP_4$, the octave range is switched.

(1) In the Case of Up-Mode

In the case where the up-mode has been selected, the up/turn selection signal UT is at "1" and is applied to an OR circuit 164 and an AND circuit 165. A flip-flop 166 is reset via the OR circuit 164. The flip-flop 166 operates to control the count mode of a reversible counter 163. The output $\overline{Q}$ of the flip-flop 166 is raised to "1" when reset. The counter 163 is set in the up-count mode when the output $\overline{Q}$ is at "1". In the up-count mode, a signal "1" is applied to AND circuits 166, 167 and 168. Therefore, when the note counter 124 outputs the carry signal CARY, a signal "1" is provided by the AND circuit 167 and a count pulse is applied through an OR circuit 169 to the counter 163. Thus the counter 163 counts up whenever the carry signal CARY is produced.

The output of the 2-bit binary reversible counter 163 is applied to an adder 170, where one is added. The output of the adder 170 is the block code $AB_1$, $AB_2$ representative of the octave range of an automatic arpeggio tone and is applied to the arpeggio register 127. The reason why the addition of one is effected in the adder 170 is to make the relationships between the block code $AB_1$, $AB_2$ and the octave range as indicated in Table 2 indicated before. The relationships between the output of the counter 163 and the block code $AB_1$, $AB_2$ outputted by the adder 170 are as indicated Table 3 below:

Table 3

| Counter 163 | | $AB_2$ | $AB_1$ | Tone range |
|---|---|---|---|---|
| 0 | 0 | 0 | 1 | C2#-C3 |
| 0 | 1 | 1 | 0 | C3#-C4 |
| 1 | 0 | 1 | 1 | C4#-C5 |
| 1 | 1 | 0 | 0 | C5#-C6 |

When the output of the counter 163 reaches a value "1 1" corresponding to the highest octave, the output of an AND circuit 171 is raised to "1", and the AND circuit 167 is disabled. When the carry signal CARY is then produced, in the case of up-mode a signal "1" is provided by an AND circuit 165 and the counter 163 is reset via an OR circuit 172. Accordingly, when the highest octave is obtained, the counter 163 carries out the up-count starting from a value "0 0" corresponding to the lowest octave. again. Thus, in the case of up-mode, the octave range of the automatic arpeggio tone repeats the increment to the highest octave from the lowest octave.

(2) In the Case of Turn-Mode

In the case where the turn-mode has been selected, the up/turn selection signal UT is at "0", and the output of an inverter 173 is set to "1". The output "1" of the inverter 173 is applied to the AND circuit 168. The flip-flop 166 and the counter 163 are reset by the reset signal of the reset line 136 during the initial period of time. Therefore, the output $\overline{Q}$ of the flip flop 166 is at "1", instruction the up-count. In the case of the up-count, similarly as in the above-described up-mode, the count pulse is applied to the counter 163 via the AND circuit 167 and the OR circuit 169 with the aid of the carry signal CARY from the note counter 124, and the carry signal CARY is subjected to up-count in the counter 163. Accordingly, the octave range specified by the block code $AB_1$, $AB_2$ is successively shifted up. When the count value of the counter 163 reaches the value corresponding to the highest octave, the AND circuit 171 outputs the signal "1" which is applied to the AND circuit 168. In the case of turn-mode, the AND circuit 165 is maintained disabled. The signal $\overline{Q}$ ("1") representative of the up-count state is applied to the other input terminal of the AND circuit 168 by the flip-flop 166. When, under this condition, the carry signal CARY is provided, the condition of the AND circuit 168 is satisfied, and therefore the flip-flop 166 is set via the OR circuit 177 (counting one (1)). Therefore, the output Q of the flip-flop 166 is set to "0", and the count 163 is placed in the down-count state. In this case, the count value of the counter 163 is "1 1". The output $\overline{Q}$ (signal "0") of the flip-flop 166 is inverted by the inverter 176 and is applied to AND circuits 174 and 175. The AND circuit 167 is disabled. In the case of down-count, the carry signal CARY is selected by the AND circuit 174 and is then applied to the counter 163. Whenever the carry signal CARY is applied to the counter 163, the counter 163 counts down by one. When three carry signals CARY are applied to the counter 163, the count value of the counter 163 becomes "0 0", and the NOR circuit 178 outputs a signal "1". The AND circuit 174 is disabled by the output "1" of the NOR circuit 178. Therefore, when the next carry signal CARY is provided, the condition of the AND circuit 175 is satisfied, and the flip-flop 166 counts one (1) via the OR circuit 177. The flip-flop 166 is a 1-bit counter, and as its previous data was "1" ($\overline{Q}$ being "0"), it is omverted tpto "0" ($\overline{Q}$ being "1"). Thus, the up-count state is obtained again.

Thus, the count value of the octave counter 163 repeats increment and decrement, and the octave range specified by the block code $AB_1$, $AB_2$ also repeats increase (successively switching from the lowest octave to the highest octave) and decrease (successively switching from the highest octave to the lowest octave).

The above-described octave designating processing is carried out whenever the process (a series of processings for the states $ST_1$ - $ST_3$) for one arpeggio note is effected. When the arpeggio key code generation signal ART, only the block code $AB_1$, $AB_2$ stored in the arpeggio register 127 is utilized as a code forming the key code $AN_1$-$AB_2$ for the automatic arpeggio tone.

Description of Actual Example of Arpeggio Performance: (1)

Figure 11:
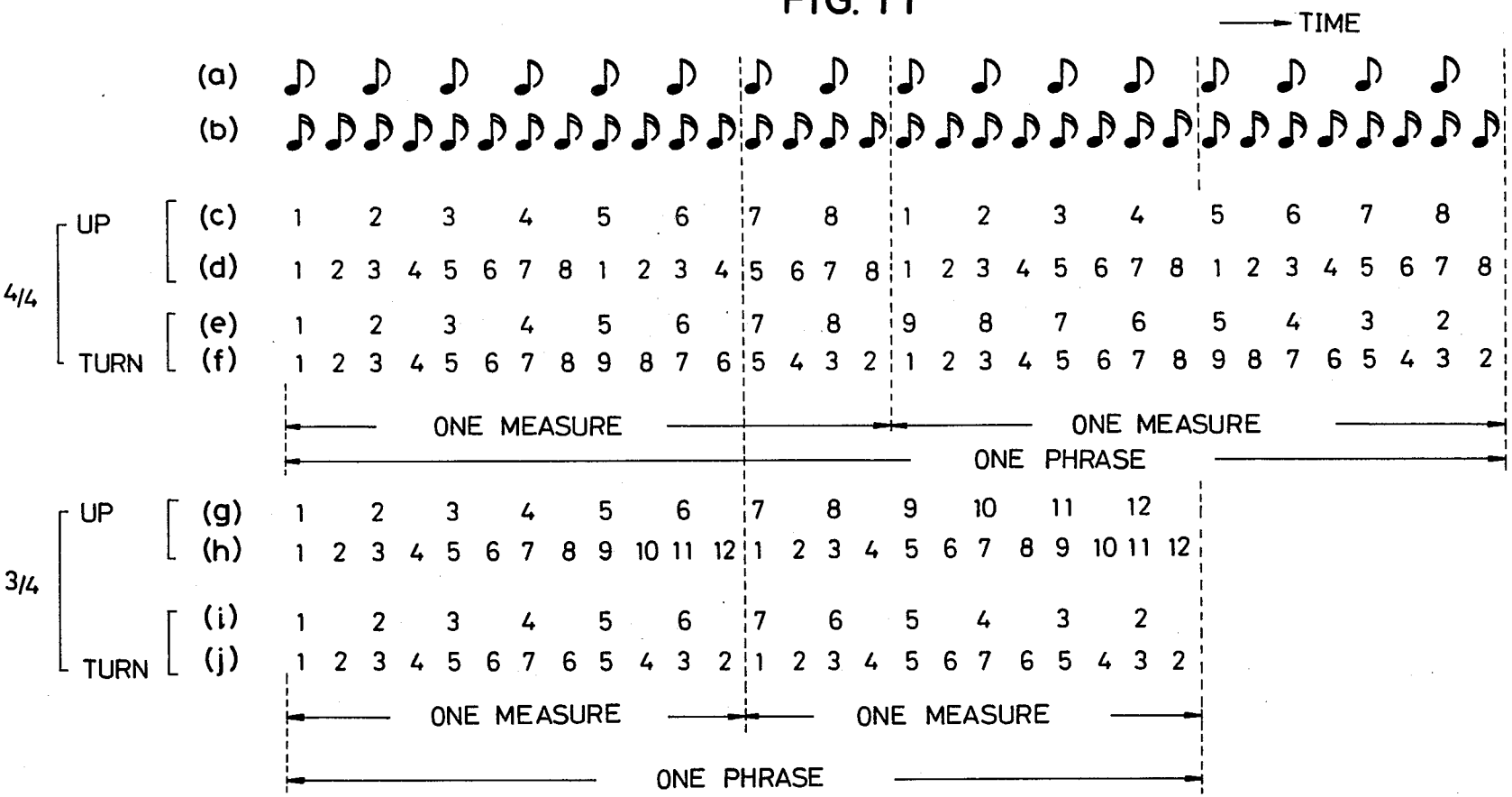
FIGS. 11(*a*) to 11(*j*) are diagrams showing some examples of the arpeggio pattern.

FIG. 11 shows several arpeggio patterns. The parts (a) and (b) of FIG. 11 show the tone production timing of arpeggio tones by means of notes. The part (a) shows the timing of eighth notes, and the part (b) shows the timing of sixteenth notes. The parts (c) through (j) of FIG. 11 show arpeggio patterns, respectively, In the parts (c) through (j), numerals described in coincidence with the timing of notes in the parts (a) and (b) are those denoted the numerical values represented by the arpeggio pattern signals $AP_1$-$AP_4$ in decimal notation, and have the same meaning as that in the part (b) of FIG. 9.

For instance, in the case where the rhythm selected by the rhythm selector 22 (FIG. 2) is 4/4 meter, among the patterns in FIG. 11 the patterns indicated in the parts (c) through (f) are selected. In the case where the rhythm selected by the rythm selector 22 is ¾ meter, the patterns in the parts (g) through (j) are selected. When the up-mode is selected by the arpeggio mode change-over switch 22M (FIG. 2), the patterns in the parts (c) and (d) are selected out of the patterns in the parts (c) through (f), or the patterns (g) and (h) are selected out of the patterns (g) through (j). When the turn-mode is selected by the arpeggio mode change-over switch 22M, the patterns (e) and (g) or the patterns (i) and (j) are selected. Furthermore, when it is instructed by the beat change-over switch 22B (FIG. 2) that the tone production should be carried out with the timing of an eighth note, the pattern in the part (c), (e), (g) or (i) of FIG. 11 is selected. When it is instructed that the tone production should be effected with the timing of a 16th note, the pattern in the part (d), (f), (h) or (j) of FIG. 11 is selected.

Thus, among the arpeggio patterns in the parts (c) through (j) of FIG. 11, a single arpeggio pattern is selected by the operation of the rhythum selector 22, the arpeggio mode change-over switch 22M and the beat change-over switch 22B, and the pattern signal $AP_1$-$AP_4$ is repeatedly produced by the pattern generator 21 (FIG. 2) in accordance with the single arpeggio pattern thus selected. An arpeggio pattern to be selected by the arpeggio variation selection switch 22A (FIG. 2) is not shown in FIG. 11. The arpeggio patterns shown in FIG. 11 are of one variation selected by the arpeggio variation selection switch 22A.

The timing of notes shown in the part (a) or (b) of FIG. 11 is determined by the tempo frequency division circuit 23 (FIG. 2). As was described before, the output of the tempo frequency division circuit 23 is used for production of the automatic rhythum pattern pulse RPP also, and therefore, the timing and phrase of notes of the automatic arpeggio tone coincide completely with the automatic rhythum.

If an arpeggio pattern to be performed is determined once, the number of notes in one phrase, the timings thereof, and the repetitive pattern are never changed even if the number of arpeggio constituents is changed. Especially, the timing of returning to the first note is not changed in the repetitive pattern, and therefore the length of the phrase in a series of automatic arpeggio performances is not changed no matter how many notes constitute the arpeggio.

This will be described in more detail with reference to FIG. 12. The part (a) of FIG. 12 shows a performance with three arpeggio constituents (D, E and F). The part (b) shows a performance with four arpeggio constituents (D, E, F and G). The part (c) shows a performance with one arpeggio constituent. In the examples shown in FIG. 12, a turn-mode pattern of $\frac{3}{4}$ meter as shown in the part (i) of FIG. 11 is employed. In this pattern, one phrase is made up of two measures.

In the case where three keys D, E and F are depressed in the lower keyboard, the lowest mode D is selected when the value of the arpeggio pattern signal $AP_1$-$AP_4$ is "1". Referring back to FIG. 8, if the lowest note D is detected only once via the comparator 123 and the AND circuit 126, the output AEQ of the comparator 159 is raised to "1" (the contents "0 0 0 1" of the arpeggio pattern register 158 coinciding with the contents "0 0 0 1" of the tone number counter 160), and the arpeggio note key code generating signal ART is produced. In this operation, the contents of the counter 163 for octave information is "0 0" (the carry signal CARY is not produced yet), and as a result of the addition of one (1) in the adder 170 the block code $AB_2$, $AB_1$ becomes "0 1". Accordingly, with the timing of generation of the automatic arpeggio selection signal ARP, the arpeggio key code $AB_2$, $AB_1$, $AN_4$, $AN_3$, $AN_2$, $AN_1$ that is "0 1 0 0 1 0" representative of the note $D_2$ is outputted by the automatic arpeggio tone production timing.

When the arpeggio pattern signal $AP_1$-$AP_4$ of two (2) in decimal notation is produced with the next arpeggio tone production timing, the second note from the lowest, that is, the note E is selected. As the carry signal CARY is not provided yet, the block code $AB_2$, $AB_1$ is "0 1" representative of the lowest octave (1 oct), and the key code $AN_1$-$AB_2$ of the note $E_2$ is outputted by the automatic arpeggio circuit 14. When the value of the arpeggio pattern signal $AP_1$-$AP_4$ reaches three (3), the third note $F_2$ is selected. Accordingly, the key code $AN_1$-$AB_2$ for the note $F_2$ is outputted by the automatic arpeggio circuit 14.

When the value of the arpeggio pattern signal $AP_1$-$AP_4$ reaches four (4), as the number of arpeggio composing note is three (3) the lowest note D is selected after one carry signal CARY is produced by the note counter 124. As a result, the counter 163 for octave counts up by one, and the block code $AB_2$, $AB_1$ becomes a value "1 0" representative of the second octave (2 oct). Therefore, the arpeggio key code $AB_2$, $AB_1$, $AN_4$, $AN_3$, $AN_2$, $AN_1$ of the fourth tone is "1 0 0 0 1 0", specifying the note $D_3$. In the case where the value of the arpeggio pattern signal $AP_1$-$AP_4$ is five (5) and six (6), the notes E and F are selected, respectively, after one carry signal CARY is produced. Therefore, the key codes $AN_1$-$AB_2$ for the notes $E_3$ and $F_3$ in the second octave (2 oct) range are produced.

When the value of the arpeggio pattern signal $AP_1$-$AP_4$ is seven (7), the seventh note that is the lowest note D is selected after the carry signal CARY is provided twice by the note counter 124. In this operation, the counter 163 for octave counts up by two, and the block code $AB_2$, $AB_1$ becomes "1 1" representative of the third octave (3 oct). Accordingly, the key code $AB_2$-$AN_1$ "1 1 0 0 1 0" representing the note $D_4$ is produced, and the note $D_4$ is produced via the arpeggio exclusive channel (the 14th channel).

After the seventh note that is the highest note has been specified, the value of the arpeggio pattern signal $AP_1$-$AP_4$ is decreased in the order of "6", "5", "4", "3" and "2". Therefore, the 6th note $F_3$, 5th note $E_3$, 4th note $D_3$, 3rd note $F_2$ and 2nd note $E_2$ are successively produced in the described order. Upon completion of one phrase, the production is returned to the top of the phrase, and as shown in the part (a) of FIG. 12 the tone production is repeated in the order of $D_2$, $E_2$, $D_3$, $E_3$, $F_3$, $D_4$, $F_3$, $E_3$, $D_3$, $F_2$ and $F_2$, whereby the arpeggio performance in the turn-mode repeating the increase and decrease of tone pitch is carried out.

In the case of four arpeggio comprising notes D, E, F and G as shown in the part (b) of FIG. 12, the contents of the block corde $AB_2$, $AB_1$ is "0 1" representative of the lowest octave (1 oct) when the value of the arpeggio pattern signal $AP_1$-$AP_4$ is one "1", two "2", three "3" or four "4". Therefore, the notes $D_2$, $E_2$, $F_2$ and $G_2$ are successively produced. When the value of the arpeggio pattern signal $AP_1$-$AP_4$ is five "5", f six ("6" or seven "7", the carry signal CARY is provided once. Therefore, the contents of the block code $AB_2$, $AB_1$ become "1 0" representing the second octave (2 oct), and the notes $D_3$, $E_3$ and $F_3$ are produced one after another. In the arpeggio pattern shown in the part (i) of FIG. 11 (used in FIG. 12), the seventh note is the highest and the tone pitch is decreased in the order of "6", "5", "4", "3" and "2". Therefore, after the note $F_3$, the notes $E_3$, $D_3$, $G_2$, $F_2$ and $E_2$ are produced one after another. Upon completion of one phrase, the tone production is returned to the top of the phrase, and the notes $D_2$, $E_2$, $F_2$, $G_2$, $D_3$, $E_3$, $F_3$, $E_3$, $D_3$, $G_2$, $F_2$ and $E_2$ as shown in the part (b) of FIG. 12 are produced in the described order in accordance with the arpeggio pattern signal $AP_1$-$AP_4$.

As is clear from the parts (a) and (b) of FIG. 12, all the arpeggio composing notes are not always produced in each octave range, that is, the tone production is carried out in accordance with the arpeggio pattern. In the part (b) of FIG. 12, the note G in the second octave (2 oct), i.e. the note $G_3$ is not produced. In the part (a) of FIG. 12, only the note $D_4$ is produced in the third octave (3 oct). Accordingly, the phrases are coincident with one another no matter how many notes constitute the arpeggio. For instance, even if the number of keys depressed in the lower key board (the number of notes forming the arpeggio) is changed from three to four during the automatic arpeggio performance, the phrase is not affected as is apparent from the parts (a) and (b) of FIG. 12. In other words, the lengths of the phrases, the tone production timings in the phrases, and the repetitive timings of the phrases are not changed. Thus, the automatic arpeggio performance preferable in musical can be effected.

In the examples shown in the part (a) and (b) of FIG. 12, the count value of the counter 163 (FIG. 8) never exceeds the highest value, and therefore the counter 163 carries out only the up-count operation even in the turn-mode. The count value of the counter 163 exceeds the highest value when the value of the arpeggio pattern signal $AP_1$-$AP_4$ becomes four times the number of the notes constituting the arpeggio. Such an example is shown in the part (c) of FIG. 12.

In the part (c) of FIG. 12, the arpeggio is consisting of only one note (note D), and the pattern shown in the part (i) of FIG. 11 is employed as the arpeggio pattern similarly as in the parts (a) and (b) of FIG. 12. During the initial period of time, the flip-flop 166 (FIG. 8) is reset, and therefore the counter 163 is placed in the up-count state by the signal $\overline{Q}$ ("1") Therefore, when the value of the arpeggio pattern signal $AP_1$-$AP_4$ is "1", "2", "3" or "4", the counter carries out only the up-count operation, and the count value of the counter 163 is increased in the order of "0 0", "0 1" "1 0" and "1 1 as the carry signal CARY is produced. More specifically, in the case where the number of arpeggio constituting tones (the number of keys depressed in the lower keyboard) is one, one carry signal CARY is provided by the note counter 124 while that one tone note (note D) is detected twice via the comparator 123 and the AND circuit 126; two carry signals CARY are provided by the note counter 124 while the one note is detected three times; and three carry signals CARY are provided while the one note is detected four times. The carry signal is applied, as the up-count pulse, to the counter 163 through the AND circuit 167 and the OR circuit 169. Therefore, the note D detected as the first note is $D_2$, the note D detected as the second note is $D_3$, the note D detected as the third note is $D_4$, and the note D detected as the fourth note is $D_5$. As the arpeggio pattern signal changes as "1", "2", "3" and "4", the arpeggio key codes $AN_1$-$AB_2$ for the notes $D_2$, $D_3$, $D_4$ and $D_5$ are produced.

When the value of the arpeggio pattern signal $AP_1$-$AP_5$ is "5" in value, four carry signals CARY are provided by the note counter 124 before the coincidence signal AEQ is produced by the comparator 159. When three carry signals CARY are provided, the contents of the counter 163 becomes "1 1", and the condition of the AND circuit 171 is satisfied. Accordingly, the AND circuit 167 is disabled, and no count pulse is supplied to the counter 163 even if the fourth carry signal CARY is provided. However, in the case where the counter 163 is in the up-count state ($\overline{Q}$="1") and the tune-mode is effected (the output of the inverter 173 being "1"), the AND circuit 168 is abled by the output "1" of the AND circuit 171, and when the fourth carry signal CARY is provided the AND circuit 168 provides its output "1". As a result, the state of the flip-flop 166 is changed, and the output signal $\overline{Q}$ is set to "0". Thus, the counter 163 is placed in the down-count state. However, since the count operation of the counter is not effected with the fourth carry signal CARY, the contents of the counter 163 are maintained as "1 1". Therefore, when the value of the arpeggio pattern signal $AP_1$-$AP_4$ is "5", the key code $AN_1$ $AB_2$ for the note D in the highest octave (or note $D_5$) is produced by the automatic arpeggio circuit 14.

When the value of the arpeggio pattern signal $AP_1$-$AP_4$ is six (6), five carry signals CARY are produced before the coincidence signal AEQ is outputted by the comparator 159. As was described before, when four carry signals CARY have been provided, the counter 163 is placed in the down-count state. Accordingly, the down-count pulse is applied to the counter 163 through the AND circuit 174 and the OR circuit 169 in response to the fifth carry signal CARY, as a result of which the counter 163 counts down by one and accordingly the contents of the counter 163 become "1 0". Thus, the key code $AN_1$-$AB_2$ for the ote D in the third octave (or note $D_4$) is produced by the automatic arpeggio circuit 14.

In the case where the value of the arpeggio pattern signal $AP_1$-$AP_7$ is seven "7", six carry signal CARY are provided before the coincidence output AEQ is provided by the comparator 159. Therefore, as is apparent from the above description, the counter 163 counts down in response to the 6th carry signal CARY so that the contents of the counter 163 become "0 1". Thus, the arpeggio key code $AN_1$-$AB_2$ for the note D in the second octave (or note $D_3$) is produced.

Where the value of the arpeggio pattern signal $AP_1$-$AP_4$ changes successively in the order of "6", "5", "4", "3" and "2", the key codes $AN_1$-$AB_2$ for the notes $D_4$, $D_5$, $D_4$ and $D_3$ are produced one after another similarly as in the above-described case. Thus, the arpeggio performance is repeatedly carried out the performance state shown in the part (c) of FIG. 12 as one phrase.

As is clear from the parts (a), (b) and (c) of FIG. 12, the length of one phrase, the musical tone production timing in the phrases, and the whole tendency of tone pitch variation (or the tendency of repeating the tone pitch increment and decrement) are not changed no matter how many tones compose the arpeggio.

*Description of Actual Example of Arpeggio Performance: (2)

Figure 13A:
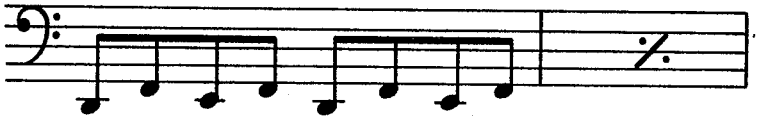
FIGS. 13(*a*) to 13(*c*) are diagrams showing an example of another arpeggio pattern according to the invention.
Figure 13B:
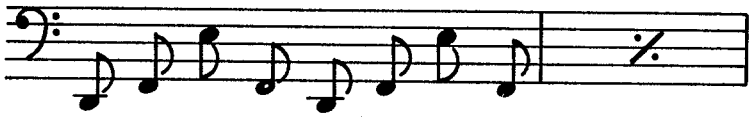
Figure 13C:
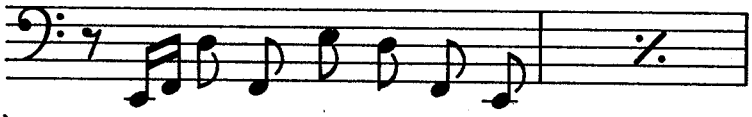

In the above-described examples (FIGS. 11 and 12), the tones are produced in the order of tone pitches. It should be noted that the invention can be applied not only to such a simple pattern but also to irregular or intricate patterns. Some examples of such irregular (or intricate) pattern are shown in FIG. 13. The pattern in the part (a) of FIG. 13 is such that the value (in decimal notation) of the arpeggio pattern signal $AP_1$-$AP_4$ changes in the order of 1→3→2→3→1→3→2→3; the pattern in the part (b) of FIG. 13 is such that the value of the arpeggio pattern signal $AP_1$-$AP_4$ changes in the order of 1→3→5→3→1→3→5→3; and the pattern in the part (c) of FIG. 13 is such that the value of the arpeggio pattern signal $AP_1$-$AP_4$ changes in the order of 2→3→4→3→5 4→3→2. In the pattern in the part (c) of FIG. 13, the initial half beat is a rest, and the lengths of the following two tones are of the sixteenth note. In addition, the pattern in the part (c) of FIG. 13 is not started from the lowest note. In the pattern in the part (b) of FIG. 13, the second note is skipped.

Notes are described on staff notations shown in the parts (a) through (c) of FIG. 13 with three notes D, E and F as the arpeggio constituents. In the pattern in the part (b) of FIG. 13, the second note E (or note $E_2$) is cancelled, but the note E is produced (as $E_3$) in the octave range higher by one octave with the timing of selectively producing the fifth note. In the pattern in the part (c) of FIG. 13, the first note D (or note $D_2$) is cancelled, but hte note $D_3$ is produced in the octave range higher by one octave with the timing of selectively producing the fourth notes.

Automatic arpeggio performances as shown inthe staff notations in the parts (a) through (c) of FIG. 13 can be achieved in accordance with the arpeggio patterns as shown in FIG. 13. However, the detailed description of this will be omitted because it is apparent from the above description. It goes without saying that the arpeggio patterns shown in the parts (a) through (c) of FIG. 13 are stored in the pattern generator 21 (FIG. 2) in advance, and when they are selected, the performances as shown in the staff notations are carried out.

*Description of Response of Automatic Arpeggio Performance with Respect to Variation of Key Operation in Lower Keyboard (1) Fluctuation in Key Depression Immediately after keys in the lower keyboard are depressed for the arpeggio constituents, no response is made to the fluctuation in depression of plural keys thanks to the operation of the above-described waiting time setting circuit 129 (FIG. 8).

(2) Fluctuation in Key Release

The lower keyboard key-on signal LKO is used in order to obtain through the AND circuit 126 the coincidence signal CON produced in the lower keyboard exclusive channel, in the automatic arpeggio circuit 14 in FIG. 8. This means that tones assigned to the channels where the lower keyboard key-on signal LKO is produced are handled as the arpeggio constituents. As was described before, the lower keyboard key-on signal LKO stored in the lower keyboard key-on memory 47 in FIG. 7 is maintained being stored as long as at least one key is kept depressed in the lower keyboard even though the other key is released, because the memory holding AND circuit 86 (FIG. 7) is abled by the keyboard key depression memory signal LKM.

Accordingly, even if some of the keys depressed in the lower keyboard are released, the lower keyboard key-on signal LKO is being produced at the channel times to which those released keys are assigned, and therefore the automatic arpeggio circuit 14 operates as if the keys were kept depressed. Thus, the automatic arpeggio performance will not respond to the fluctuation in depression of keys (the variation of the arpeggio composing tones when keys are released). However, it goes without saying that when the last key is released, the lower keyboard key depression memory signal LKM is eliminated, and therefore the lower keyboard key-on signals LKO for all the channels are eliminated simultaneously.

(3) Legato Key Depression

In the legato key depression, some of keys depressed in the lower keyboard are released, and while the remaining keys are being depressed, a new key is additionally depressed. When some of the keys depressed are released, the automatic arpeggio performance effected prior ato the key release is continued as was described above. When a key is additionally depressed, the lower keyboard new key-on signal LNK is provided by the AND circuit 84 (FIG. 7) in the lower keyboard exclusive channel time (cf. FIG. 4 (*d*) and (*g*)) during the second process period. As a result, the memory holding AND circuit 86 is disabled via the NOR circuit 87, and the AND circuit 83 for writing a new key board key-on signal is enabled. Therefore, the key-on signal KO concerning the lower keyboard and stored in the key-on memory 46 is written in the lower keyboard key-on memory 47 through the line 82, AND circuit 83 and OR circuit 85. As a key-on signal KO concerning a key being depressed is stored in the key-on memory 46, the lower keyboard key-on signal LKO is outputted by the lower keyboard key-on memory in accordance with the actual key depression. Accordingly, when a new key is depressed, in the legato method, in the lower keyboard, the storage in the lower keyboard key-on memory 47 is rewritten so that the arpeggio composing tones are changed into a combination according to the actual key depression to carry out the automatic arpeggio performance.

In the above-described embodiment, the arpeggio pattern signal $AP_1$-$AP_4$ represents only the order of a tone, and the octave information is not definitely determined by the arpeggio pattern signal $AP_1$-$AP_4$ but is determined by the relation between the value of the arpeggio pattern signal $AP_1$-$AP_4$ and the number of arpeggio constituents. However, the invention is not limited thereto or thereby; that is, the arpeggio pattern signal may be so designed that it contains a signal representing the order of a tones and a signal representing the octave information in parallel mode.

Figure 14:
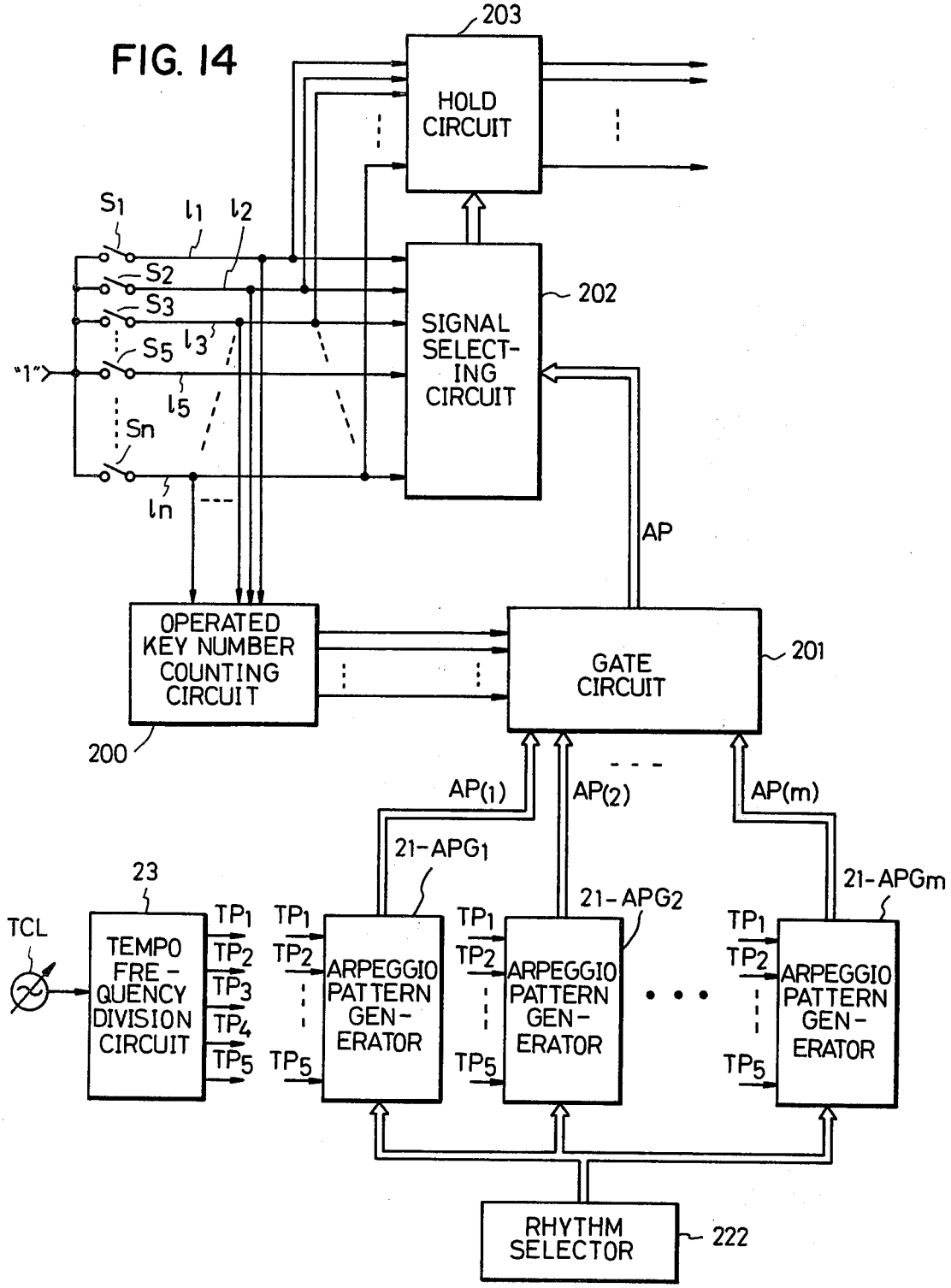
FIG. 14 is a block diagram showing another embodiment of the electronic musical instrument according to the invention.

FIG. 14 illustrates another example of the electronic musical instrument according to the invention. In FIG. 14, key switches $S_1$ through $S_n$ correspond to the keys in an arpeggio performance keyboard (such as the lower keyboard). When one or plural keys are depressed in the arpeggio performance keyboard, the switches corresponding to the keys thus depressed are turned on, and key operation signals ("1") are provided through the output lines of the keys. The signals provided through the output lines $l_1$-$l_n$ of the switches $S_1$-$S_n$ are applied to an operated key number counting circuit 200. Thus, an automatic arpeggio performance is effected with the tones of the keys depressed in the arpeggio performance keyboard as the arpeggio constituents. The operated key number counting circuit 200 operates to count the number of the keys depressed in the arpeggio performance keyboard by basing on the states of signals on the output lines $l_1$-$l_n$ of the switches $S_1$-$S_n$. For instance, when three keys are simultaneously depressed in the arpeggio performance keyboard, the count value of the circuit 200 becomes three (3).

In FIG. 14, reference character TCL designates a tempo clock pulse oscillator for setting the fundamental tempo of an automatic rhythum tone production timing. The tempo clock pulse provided by the oscillator TCL is applied to a tempo frequency division circuit 23, where it is subjected to frequency division suitably so that tempo signals $TP_1$-$TP_5$ corresponding to the durations of various notes are obtained. The tempo signals $TP_1$-$TP_5$ are applied to arpeggio pattern generators 21-$APG_1$-21-$APG_m$. Each arpeggio pattern generator comprises a read only memory storing a plurality of arpeggio patterns. An arpeggio pattern corresponding to a rhythm selected by a rhythm selector 222 is read out of the arpeggio pattern generators 21-$APG_1$-21-$APG_m$. The timing of reading an arpeggio pattern out of each arpeggio pattern generator is determined in accordance with the tempo signals $TP_1$-$TP_5$ supplied from the tempo frequency division circuit 23. The number of arpeggio pattern generators 21-$APG_1$-21-$APG_m$ corresponds to the number of arpeggio constituents. For instance, the arpeggio pattern generator 21-$APG_1$ is storing, in correspondence to the rhythms (meters), arpeggio patterns suitable for the case where the number of arpeggio constituting note is one, and the arpeggio pattern generator 21-$APG_2$ is storing, in correspondence to the rhythms (meters), arpeggio patterns suitable for the case where the number of arpeggio constituting notes is two. Similarly, the arpeggio pattern generator 21-$APG_m$ is storing, in accordance with the rhythms meters, arpeggio patterns suitable for the case where the number of arpeggio constituting notes is m.

Therefore, if the performer selects a certain rhythm with the rhythms selector 222, one arpeggio pattern corresponding to this selected rhythm (the meter of the rhythm such as 4/4 meter or $\frac{3}{4}$ meter, and the beats of the rhythm) is prepared to be read out from the corresponding memory position of the arpeggio pattern generators 21-$APG_1$-21-$APG_m$. And the corresponding one of the arpeggio pattern signals $AP_{(1)}$-$AP_{(m)}$ forming the selected arpeggio pattern is read out of the arpeggio pattern generator among 21-$APG_1$ - 21-$APG_m$ with the aid of the tempo signals $TP_1$ - $TP_5$, respectively.

The arpeggio pattern signal $AP_{(1)}$ or the apeggio pattern signals $AP_{(2)}$ through $AP_{(m)}$ are signals consisting of numerical information specifying the orders of the location of the notes which are selectively and sequentially produced among the arpeggio constituents with the ageneration timings of the arpeggio pattern signal $AP_{(1)}$ or the arpeggio pattern signals $AP_{(2)}$ through $AP_{(m)}$. The "order" is intended to mean the order of note pitches indicating the location of the note to be produced among the arpeggio constituents from the lowest note. In one arpeggio pattern, such as an arpeggio pattern signal $AP_{(1)}$ (or any of $AP_{(2)}$ through $AP_{(m)}$) is repeatedly produced in the predetermined order and with the predetermined timing.

The arpeggio pattern signals $AP_{(1)}$ through $AP_{(m)}$ provided by the arpeggio pattern generators 21-$APG_1$ through 21-$APG_m$ are applied to a gate circuit 201, where only the arpeggio pattern signal (one or $AP_{(1)}$ through $AP_{(m)}$) provided by one pattern generator (one of 21-$APG_1$ through 21-$APG_m$) is selected in accordance with the count value of the operated key number counting circuit 200. Thus, the output of the arpeggio pattern generator 21-APG corresponding to the number of the depressed keys in the arpeggio performance keyboard is selected by the gate circuit 201. The arpeggio pattern signal AP selected by the gate circuit 201 is applied to a signal selection circuit 202.

The signals on the output lines $1_1$ through $1_n$ of the key switches $S_1$ through $S_n$ in the keyboard are applied to the signal selection circuit 202. In the signal selection circuit 202, among the depressed keys, a key having the order specified by the arpeggio pattern signal AP is selected and a signal is applied to a hold circuit 203 so that the key switch output of that key is held.

For instance, in the case where key switches $S_1$, $S_3$ and $S_5$ are turned on (the corresponding keys being depressed), the count value of the circuit 200 is three (3), and therefore the arpeggio pattern signal $AP_{(3)}$ provided by the arpeggio pattern generator 21-$APG_{(3)}$ (not shown) corresponding to three (3) tones is selected by the gate circuit 201. If it is assumed that the value of the arpeggio pattern signal $AP_{(3)}$ is three (3) at a tone production timing the third key switch counted from the side of the lowest note among the key switches $S_1$, $S_3$ and $S_5$ i.e. the key switch $S_5$ is selected by the signal selection circuit 202 (the note corresponding to the key switch $S_1$ being assumed as the lowest note). In the hold circuit 203, only the key-on signal of the key switch $S_5$ selected by the signal selection circuit 202 is held, and the key-on signals of the remaining key switches are not held. When a new hold instruction is issued by the signal selection circuit 202, the old hold signal is cleared. Therefore, only the key-on signal of one note (one key switch) is held.

A note corresponding to a key switch whose key-on signal is held by the hold circuit 203 is an arpeggio note which is to be produced now. Therefore, a tone generator (not shown) is driven by the hold output of the hold circuit 203 to produce a musical tone signal corresponding to the note pitch of the key switch held.

Thus, one of the arpeggio constituents specified by the key depression is successively selected and produced in accordance with the arpeggio pattern.

Figure 15:
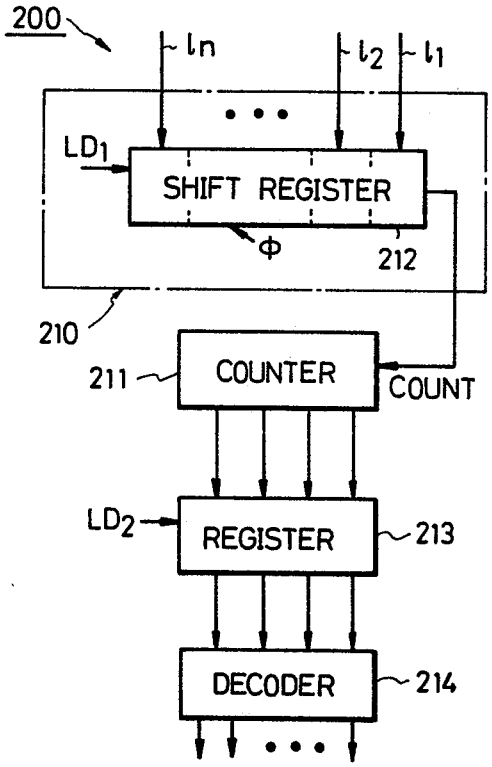
FIG. 15 is a block diagram showing an actuated key counting circuit shown in FIG. 14.

One example of the operated key number counting circuit 200 is shown in FIG. 15, which is made up of a scanning circuit 210 and a counter 211. In the example of FIG. 15, a parallel-input/series-output type shift register 212 is employed as the scanning circuit 210. The shift register 212 has stages corresponding to the key switches $S_1$ through $S_n$ so that upon application of a loading instruction signal $LD_1$ the output signals of the key switches $S_1$ through $S_n$ applied through the lines $l_1$ through $l_n$ are loaded. The signal thus loaded are successively shifted in response to a shift clock pulse $\phi$, and the output of the final stage is applied to the counter 211 where it is counted. In the counter 211, a key-on designating signal is counted. Therefore, when one cycle of scanning by the scanning circuit 210 is completed, the count value of the counter 211 represents the number of the operated keys (the number of depressed keys). Therefore, when one cycle of scanning by the scanning circuit 210 is completed, a loading instruction signal $LD_2$ is applied to a register 213 so that the count value of the counter 211 is inputted into the register 213. The output of the register 213 is applied through a decoder 214 to the gate circuit 201.

Figure 16:
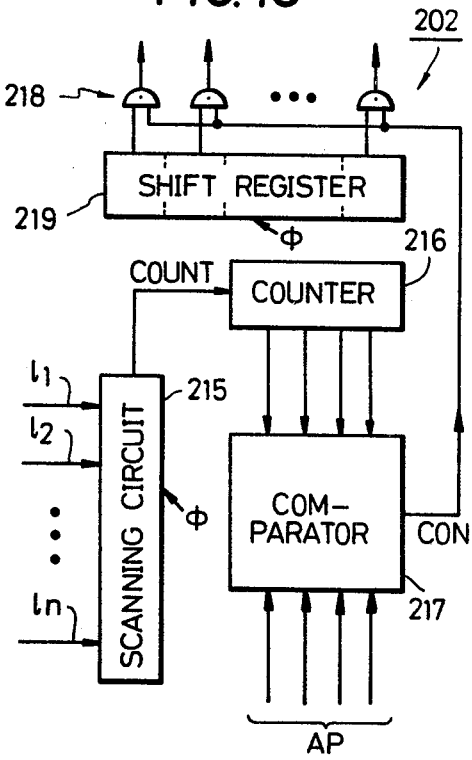
FIG. 16 is a block diagram showing an example of a signal selection circuit shown in FIG. 14.

The signal selection circuit 202, as shown in FIG. 16, may be constituted by a scanning circuit 215, a counter 216 and a comparator 217. The signals applied through the output lines $1_1$ through $1_n$ of the key switches $S_1$ through $S_n$ are scanned successively by starting from the low note side so that the key-on signals are picked up successively by starting from the low note side so as to be counted by the counter 216. The count value of the counter 216 is successively compared with the value of the arpeggio pattern signal AP in the comparator 217. When the both coincide with each other, a coincidence signal CON is applied to an AND circuit group 218 to enable the latter 218. A shift register 219 operates to shift a signal "1" in response to the shift clock pulse $\phi$. The shift operation of the shift register 219 is in synchronization with the scanning timing of the scanning circuit 215. Therefore, when the coincidence signal CON is produced, the single signal "1" is in the position (the state in the shift register 219) corresponding to the key switch which has provided the coincidence, and among the AND circuits forming the AND circuits group 218, one AND circuit corresponding to the key switch providing the coincidence outputs a signal "1". This output of the AND circuit group 218 is applied, as the hold instruction signal, to the hold circuit 203.

Figure 17:
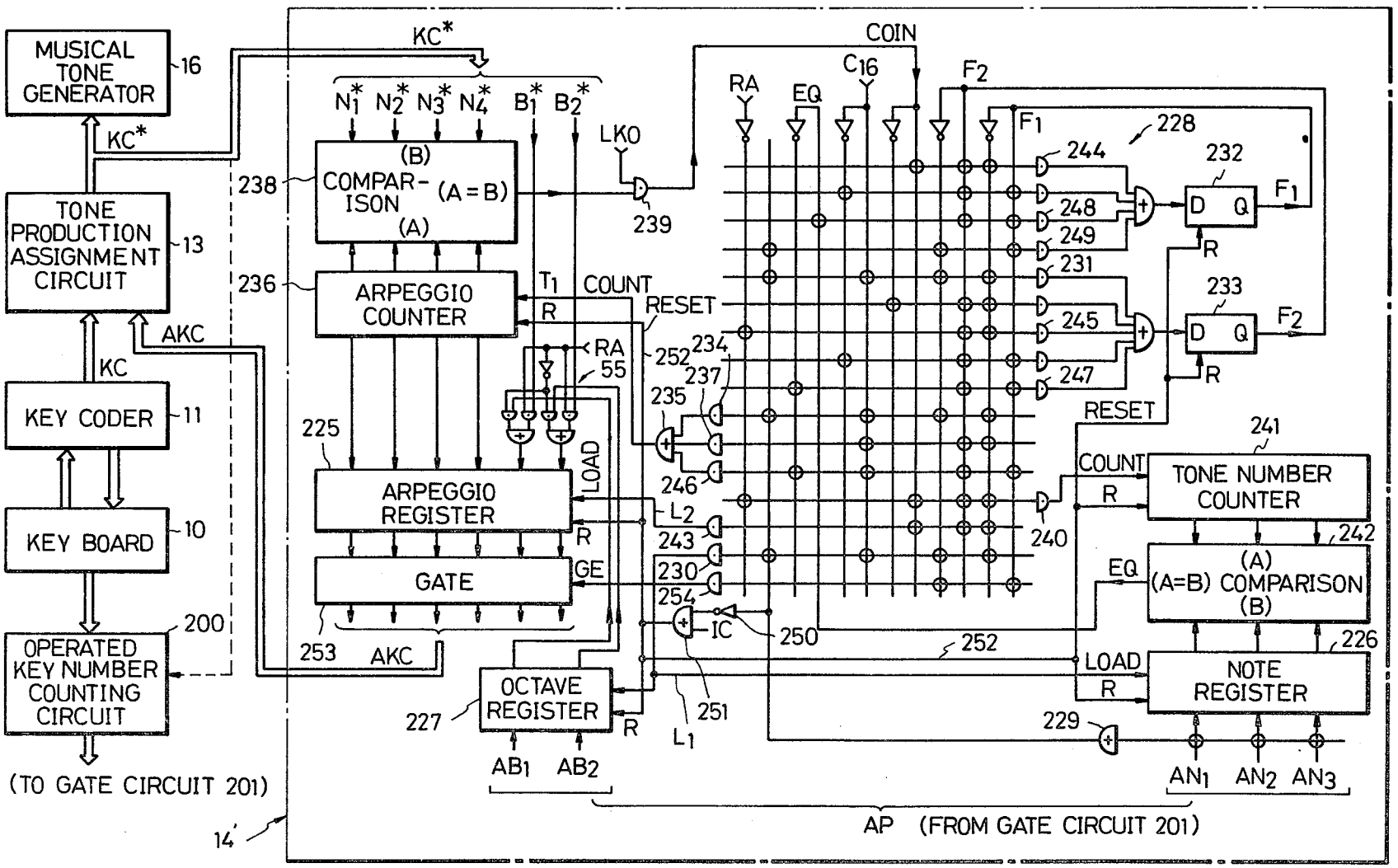
FIG. 17 is a block diagram showing still another example of the electronic musical instrument according to the invention.

In the example shown in FIG. 14, the signals from the key switches are separately applied to the signal selection circuit 202; however, the invention is not limited thereto or thereby; that is, the invention can be applied to an electronic musical instrument in which key depression is processed by coding. FIG. 17 shows one example of an electronic musical instrument of this type to whichthe technical concept of the invention is applied.

Figure 18:
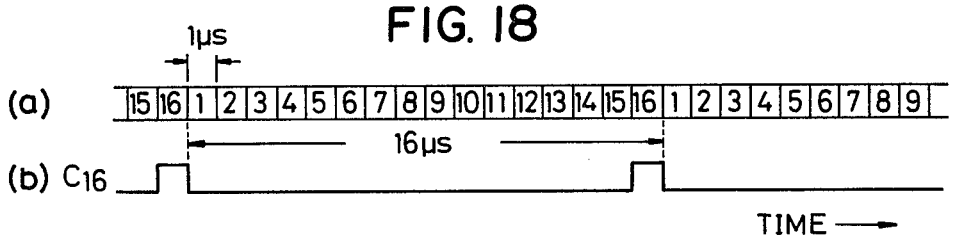
FIGS. 18(*a*) and 18(*b*) are time charts illustrative of timing relations between the circuits shown in FIG. 17.
Figure 19A:
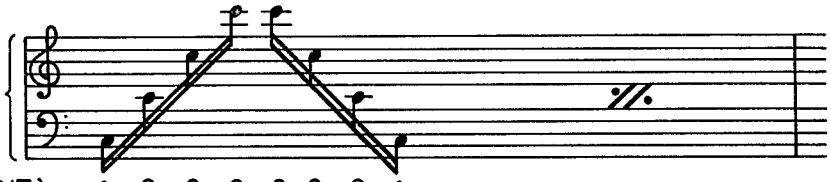
FIGS. 19(*a*) to 19(*d*) are diagram showing an example of the arpeggio pattern used in the embodiment shown in FIG. 14.
Figure 19B:
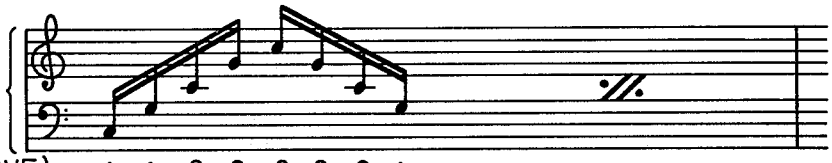
Figure 19C:
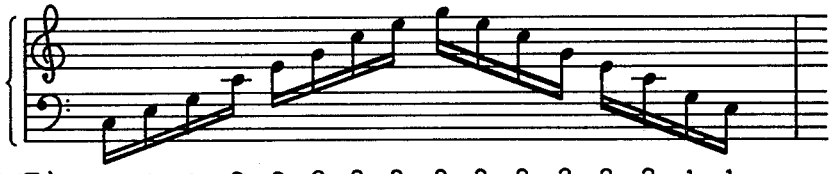
Figure 19D:
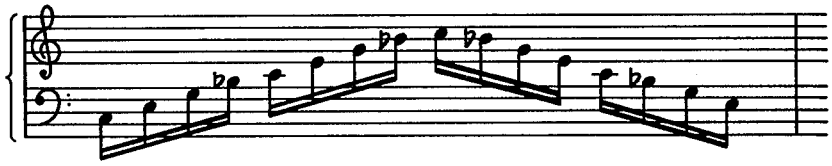

Referring to FIG. 17, a key coder 11 operates to detect the on-off operation of each key in a keyboard 10 thereby to provide a key code KC representative of a key depressed. A channel processor 13 operates to assign the tone production of a key depression to one of a particular number of tone production channels (for instance sixteen (16) tone production channels), and to output in time division mode the key codes KC* of key assigned to the tone production channels, separately according to the respective channel times. One example of time-divisioned channels (i.e. time slots) is shown in FIGS. 18(*a*) and 18(*b*), in which reference numerals 1 through 16 designate the channels. The width of each channel is, for instance, one microsecond (1 $\mu$s) The Key code KC* assigned is applied to a tone generator 16 and to a automatic arpeggio circuit 14'. The tone generator produces the musical tone signal of keys assigned to the channels in accordance with the key code KC*.

This automatic arpeggio circuit 14' corresponds to the signal selection circuit 202 and the hold circuit 203 in FIG. 14. More specifically, in the circuit 14', a register 225 (hereinafter referred to as "an arpeggio register 255" when applicable) corresponds to the hold circuit 203, and the remaining circuits correspond to the signal selection circuit 202.

Similarly as in FIG. 14, the outputs of key switches in the keyboard 20 may be introduced to a operated key number counting circuit 200; however, the counting circuit 200 may be so designed as to count the number of key codes KC* (or key-on signals KO) outputted by the channel processor 13 as indicated by the broken line. For instance, in the case where an automatic arpeggio is performed with the notes of the keys depressed in the lower keyboard as the arpeggio constituents, an arpeggio pattern corresponding to the number of keys depressed in the lower keyboard, i.e. the number of the automatic arpeggio constituting notes is detected by the operated key number counting circuit 200. A circuit for detecting an arpeggio pattern corresponding to the number of the keys operated, or the number of arpeggio constituting notes (the tempo clock pulse oscillator TCL, the tempo frequency division circiut 23, the multiplexer 201, the rhythm selector 222, and the arpeggio pattern generators 21-APG$_1$ through 21-APG$_m$) may be replaced by the same one as described with reference to FIG. 14, and it is not shown in FIG. 17. The arpeggio pattern signal AP selected by the multiplexer 201 (FIG. 14) is applied to a note register 226 and an octave register 227 in the automatic arpeggio circuit 14'.

In the example shown in FIG. 17, the arpeggio pattern signal AP consists of a 2-bit octave code AB$_1$, AB$_2$ representative of the octave range of the tones to be produced according to the arpeggio pattern signal AP and a 3-bit order value information AN$_1$, AN$_2$, AN$_3$ representative of the order in note pitch of the note to be selected among the arpeggio composing tones constitutents. The order value information AN$_1$, AN$_2$, AN$_3$ is applied to the note register 226, while the octave code AB$_1$, AB$_2$ is applied to the octave register 227. One example of the relation between the octave code AB$_1$, AB$_2$ and the octave range is as indicated in Table 4 below:

Table 4

| AB$_2$ | AB$_1$ | Octave Range |
|---|---|---|
| 0 | 1 | First Octave ($C_3$–$B_3$) |
| 1 | 0 | Second octave ($C_4$–$B_4$) |
| 1 | 1 | Third octave ($C_5$–$B_5$) |
| 0 | 0 | Fourth octave ($C_6$–$B_6$) |

The relation between the order value information AN$_1$ - AN$_3$ and the note pitch order selected thereby is indicated in Table 5 below:

Table 5

| AN$_3$ | AN$_2$ | AN$_1$ | Note Pitch Order |
|---|---|---|---|
| 0 | 0 | 1 | Lowest note |
| 0 | 1 | 0 | Second note from the lowest note |
| 0 | 1 | 1 | Third note from the lowest note |
| 1 | 0 | 0 | Fourth note from the lowest note |
| 1 | 0 | 1 | Fifth note from the lowest note |
| 1 | 1 | 0 | Sixth note from the lowest note |
| 1 | 1 | 1 | Seventh note from the lowest note |

A state control logic 228 is to control the operations of various circuits (especially the loading, counting and resetting operations of registers and counters) in the automatic arpeggio circuit 14'. First, when an OR circuit 227 detects an order value information AN$_1$ - AN$_3$, the output of an AND circuit 230 is raised to "1", as a result of which the load signal L$_1$ is supplied to the note register 226 and the octave register 227 thereby to input the arpeggio pattern signal AP (the order value information AN$_1$ - AN$_4$ and the octave code AB$_1$, AB$_2$) into the registers 226 and 227. The condition of an AND circuit 231 is satisfied with the timing of the final channel signal C$_{16}$ (FIG. 6, (*b*)), the state of the output signals F$_1$, F$_2$ of delay flip-flops 232 and 233 is set to "0 1". The final channel signal C$_{16}$ is produced repeatedly in synchronization with the time-division time slot of the 16th channel. With the same condition as that of the AND circuit 231, an AND circuit 23 is operated, so that the count pulse T$_1$ is applied through an OR circuit 235 to an arpeggio counter (or a 4-bit binary counter) 236. When the state of the signal F$_1$, F$_2$ is set to "0 1" as described above, the condition of an AND circuit 237 is repeatedly satisfied with the timing of the final channel signal C$_{16}$, and therefore the count pulse T$_1$ is repeatedly applied to the arpeggio counter 236. Thus, the count value of the counter 236 is increased.

The count output of the arpeggio counter 236 is applied to a comparison circuit 238 and an arpeggio register 225. Applied to the other input(B) of the comparison circuit 23B are the note codes N$_1$* - N$_4$ of the key codes KC* of tones assigned to the channel. When both inputs coincide with each other, the comparison circuit 238 applies a signal "1" to an AND circuit 239. While the count value of the arpeggio counter 236 is maintained unchanged for at least 16 μs, the value of the note code $N_1$* - $N_4$* is changed every channel time (1 μs). Therefore, comparison as to one count value is completed during 16 s. The lower keyboard key-on signal LKO is applied to the other input of the AND circuit 239, and as long as a key of the lower keyboard used as the automatic arpeggio keyboard is depressed in the time of the channel to which the key is assigned, the AND circuit 239 is maintained enabled.

As is apparent from the above description, in the section consisting of the counter 236, comparison circuit 238 and AND circuit 239, the arpeggio constituents (or the lower keybaord's key code KC*) are detected one after another. In other words, the count value of the arpeggio counter 236 obtained when the signal "1" (the coincidence signal CON) is outputted by the AND circuit 239 coincides with the note code $N_1$* - $N_4$* of one arpeggio composing tone detected. The note code $N_1$* - $N_4$* is to specify one of twelve (12) notes (C thorugh B). Since the arpeggio counter 236 is an up-counter, the notes are detected in the order of increasing value of note code $N_1$* - $N_4$* (for instance, starting from the lowest note).

Upon provision of the coincidence signal COIN, the condition of an AND circuit 240 is satisfied (assuming that the random mdoe instruction signal RA is at "0"), and a count pulse is applied to a tone number counter 241 comprising a 3-bit binary counter. Therefore, the count value of the tone number counter 241 is increased by one (1) whenever the coincidence signal COIN is produced. A comparison circuit 242 operates to compare the count value of the counter 241 with the order value information $AN_1$ - $AN_3$ of the arpeggio pattern signal AP stored in the note register 226, and when the both coincide with each other, outputs a coincidence signal EQ. A value obtained by counting the arpeggio constituting notes (of the lower keyboard) successively from the lowest note is stored in the tone number counter 241, and therefore the count value which is held in the arpeggio counter 236 when the coincidence signal EQ is produced represents the note of one arpeggio constituent corresponding to the note pitch order specified by the order value information $AN_1$ - $AN_3$.

Whenever the count pulse is applied to the tone number counter 241 through the AND circuit 240, the load signal $L_2$ is supplied to the arpeggio register 225 through an oND circuit 243, as a result of which the count value of the arpeggio is inputted thereinto. Simultaneously, the octave code $AB_1$, $AB_2$ stored in the octave register 227 is inputted into the arpeggio register 225 through a gate 255. Accordingly, also when the coincidence signal EQ is produced, the count value of the arpeggio counter 236 is inputted into the arpeggio register 225, and the data held by the arpeggio register 225 in this operation corresponds to the key code of the note selected with the aid of the arpeggio pattern signal AP. Accordingly, if the tone corresponding to the data held by the arpeggio register 225 in this case is produced by the tone generator 223, when the automatic arpeggio performance is effected just in accordance with the arpeggio pattern.

If the coincidence signal EQ is produced once, rewriting the data held by the arpeggio register 222 is not carried out unless the value of the arpeggio pattern signal AP is changed. When first the coincidence detection signal COIN is produced by the AND circuit 239, the state of the signal $F_1$, $F_2$ is changed to "1 1" with the aid of the outputs "1" of the AND circuits 244 and 245, and the count pulse $T_1$ is supplied to the arpeggio counter 236 in accordance with the output of the AND circuit 246. If, in this case, the coincidence signal EQ is not provided, only the AND circuit 247 is operated, and the state of the signal $F_1$, $F_2$ is set to "0 1" again. Therefore, supply of the count pulse $T_1$ through the AND circuit 237 is effected again. Thus, until the coincidence signal Eq is produced, the state of the signal $F_1$, $F_2$ is set alternately to "0 1" and "1 1". On the other hand, when the coincidence signal EQ is produced, an AND circuit 248 is operated, so that the state of the signal $F_1$, $F_2$ is set to "1 0", which is held via an OR circuit 229 and an AND circuit 249. When the time of producing one arpeggio tone is over, the arpeggio pattern signal AP is eliminated (becomes "0") Then, the condition of the AND circuit 249 is not satisfied, and therefore the signal $F_1$, $F_2$ is set to "0 0". In addition, the output of the OR circuit 229 is set to "0", and the reset signal R is supplied to a reset line 252 through an inverter 250 and an OR circuit 251, as a result of which all of the registers and counters are reset.

The data held by the arpeggio register 225 is supplied to the channel processor 222 through a gate 253 when the signal $F_1$, $F_2$ is set to "1 0" in response to the coincidence signal EQ. In other words, when the signal $F_1$, $F_2$ has "1 0", the condition of an AND circuit 254 is satisfied so that a gate opening signal GE is continuously applied to the gate 53. In the channel processor 13, the data supplied through the gate 253 is handled as the key code (AKD) for the arpeggio tone and is assigned to a predetermined channel, and thereafter it is supplied to the tone generator 16. Accordingly, the arpeggio tone is produced by the tone generator 16.

In the above description, the octave range of the r arpeggio tone (arpeggio key code AKC) is determined by the octave code $AB_1$, $AB_2$ in the arpeggio pattern signal AP; however, in the case of application of the random mode instruction signal RA, the octave code $AB_1$, $AB_2$ in the arpeggio pattern signal AP is blocked by the gate 255, and the octave information $B_1$*, $B_2$* in the assigned key code KC* from the channel processor 13 is inputted into the arpeggio register 225.

Shown in FIG. 19 is one example of arpeggio patterns different according to the number of arpeggio constituting notes (the number of depressed keys). In the case of FIG. 19, a rythm of 4/4 meter is selected by the rythm selector 19 (FIG. 14), and the basic note length of the rythm is an ordinary note (divided by Z's power) and not a triplet. In FIG. 19, the numerals 1, 2, 3 and 0 in the column "octave" are the decimal numbers of the octave codes $AB_1$, $AB_2$; and the numerals 1, 2, 3, 4 . . . in the column "order" are the decimal number of the order value information $AN_1$-$AN_3$.

The part (a) of FIG. 19 shows a pattern in which the number of arpeggio constituting note is one, and the pattern is produced by the arpeggio pattern generator 21-$APG_1$ in FIG. 14 for instance. The octave code $AB_2$, $AB_1$ of the arpeggio pattern signal AP ($AP_1$) changes repeatedly in the order of the first octave (1)→the second octave (2)→the third octave (3)→the fourth octave (0)→the fourth octave (0)→the third octave (3)→the second octave (2)→the first octave (1). The order value information $AN_1$-$AN_4$ of the arpeggio pattern signal AP ($AP_1$) repeats the value (1 in decimal notation)

specifying the lowest note. In the part (a) of FIG. 19, notes are described with reference to the case where the keys for the note C are depressed. Therefore, in this case, the notes are repeatedly produced in the order of $C_3 \rightarrow C_4 \rightarrow C_5 \rightarrow C_6 \rightarrow C_6 \rightarrow C_5 \rightarrow C_4 \rightarrow C_3$.

The part (b) of FIG. 19 shows a pattern in which the number of arpeggio constituting notes are two, and the pattern is provided by the arpeggio pattern generator 21-$APG_2$ in FIG. 14 for instance. In this case, notes C and G form the arpeggio.

The part (c) of FIG. 19 shows a pattern in which the number of arpeggio constituting notes are three, and they are notes C, E and G. The part (d) of FIG. 19 shows a pattern in which the number of arpeggio constituting notes are four, and they are notes C, E, G and A#(B♭).

What is claimed is:

1. An electronical musical instrument of a type capable of selectively sounding one or more designated tones, comprising:

sounding tone designating means for designating tones to be sounded;

constituent order nominating means, connected to said sounding tone designating means, for specifying the pitch order values of the respective designated tones when repeated through octaves;

an order pattern generator for generating numerical signals timewisely aligned one after another in a predetermined pattern, said numerical signals respectively defining the ordinal pitch locations of the constituents of an arpeggio to be played, said numerical signals being generated independently of the pitch order values of the designated tones;

tone selection means, connected to said constituent order nominating means and to said order pattern generator, for selecting tones which, with respect to said specified pitch order values, are in the ordinal locations identified by said numerical signals; and musical tone producing means, connected to said tone selection means, for producing musical tones corresponding to the selected tones.

2. An electronic musical instrument as defined in claim 1 wherein said order pattern generator comprises;

memory means storing plural kinds of patterns for generating said numerical signals;

pattern selection means for selecting one of said patterns; and reading means for repeatedly reading out said numerical signals in accordance with the selected pattern;

whereby the designated tones are produced in accordance with the selected pattern.

3. An electronic musical instrument as defined in claim 1 or 2 wherein said order pattern generator establishes the timing for generating said numerical signals by utilizing a tempo signal used for setting a timing for generating an automatic rhythm sound.

4. An electronic musical instrument as defined in claim 2 wherein said pattern selection means selects a pattern corresponding to the number of actually depressed keys.

5. An electronic musical instrument as defined in claim 2 which further comprises:

detection means for detecting the number of actually designated tones; and in which instrument: said memory means storing a plurality of patterns corresponding in number to the designated tones; and said pattern selection means selecting said patterns corresponding to the number of the designated tones detected by said detection means.

6. An electronic musical instrument as defined in claim 5 wherein said instrument is of a keyboard type and said detection means count the number of keys being depressed in a keyboard.

7. An electronic musical instrument of a type capable of selectively sounding one or more tones designated by key depression comprising:

sounding tone designating means for designating tones to be sounded;

constituent order nominating means, connected to said sounding tone designating means, for specifying the pitch order values of the respective designated tones when repeated through octaves;

an order pattern generator for generating numerical signals timewisely aligned one after another in a predetermined pattern, said numerical signals respectively defining the ordinal pitch locations of the constituents of an arpeggio to be played;

tone selection means connected to said constituent order nominating means and to said order pattern generator for selecting tones which, with respect to said specified pitch order values, are in the ordinal locations identified by said numerical signals;

musical tone producing means, connected to said tone selection means, for producing musical tones corresponding to the selected tones, and wherein said constituent order nominating means comprises:

a first circuit for counting the designated tones in the order of their tone pitch; and wherein said tone selection comprises:

a second circuit for comparing a numerical value counted by said first circuit with said numerical signals and detecting coincidence therebetween; and a third circuit for selectively outputting tone information for one of the designed tones counted by said first circuit when said second circuit has detected coincidence.

8. In an electronic musical instrument of the type having a tone generator for generating musical tones designated by note codes supplied thereto, an automatic arpeggio system comprising:

arpeggio constituent note selection means for providing selected note signals corresponding to the names of one or more notes selected for inclusion in said arpeggio, arpeggio pattern generator means for generating an arpeggio pattern signal consisting of a sequence of pitch location numbers each specifying the ordinal position of a tone with respect to pitch, said pattern signal establishing the sequence in which selected notes are to be generated in said arpeggio, said pattern signal being generated independently of which particular notes are selected for inclusion in said arpeggio, and signal selecting means, cooperating with said note selection means and said pattern generator means and receiving said selected note signals and responsive to occurrence of each pitch location number in said sequence, for providing to said tone generator a note code designating the selected note having a pitch ordinal position corresponding to that specified by said pitch location number.

9. An automatic arpeggio system according to claim 8 further comprising:

octave control means, cooperating with said signal selecting means and operative when the value of the pitch location number exceeds the quantity of different selected notes, for providing to said tone generator a note code designating the selected note having a pitch ordinal position which, when counted by modulo the quantity of selected notes, corresponds to said pitch location number, said provided note code specifying an octave different from that of the corresponding selected note.

10. An automatic arpeggio system according to claim 8 comprising:

selected note counting means, cooperating with said constituent note selection means, for ascertaining the quantity of notes selected for inclusion in said arpeggio, a plurality of like arpeggio pattern generator means each generating an arpeggio pattern signal for a respective different quantity of selected notes, and gating means, cooperating with said counting circuit means, for providing to said signal selecting means the arpeggio pattern signal from the one arpeggio pattern generator means that generates a pattern signal for the quantity of selected notes corresponding to that ascertained by said counting means.

11. An automatic arpeggio system for a keyboard musical instrument of the type having a tone generator for generating musical tones specified by note codes supplied thereto, said system comprising:

arpeggio constituent note selection means for providing selected note signals corresponding to the names of one or more notes selected for inclusion in said arpeggio, arpeggio pattern generator means for generating an arpeggio pattern signal consisting of a sequence of pitch location numbers each specifying the position of a tone in order of pitch, said pattern signal establishing the sequence in which selected notes are to be generated in said arpeggio, signal selecting means, cooperating with said note selection means and said pattern generator means and receiving said selected note signals and responsive to occurrence of each pitch location number in said sequence, for providing to said tone generator a note code corresponding to the note signal of the selected note having a pitch order position corresponding to that specified by said pitch location number, and wherein said constituent note selection means comprises:

a key coder, responsive to keys depressed in a certain keyboard of said instrument, for providing said selected note signals in the form of digital key codes having numerical values corresponding to the order of pitch of each note name, and wherein said signal selecting means comprises:

a note counter of modulo equal to the total number of note names, and means for incrementing said note counter upon occurrence of each pitch location number, a comparator for comparing the contents of said note counter with the numerical value of the selected note signal, a tone number counter, incremented each time there is coincidence between the contents of said note counter and the selected note signal, and circuitry, cooperating with said means for incrementing, for terminating the incrementing of said note counter when the contents of said tone number counter equals the value of said pitch location number, said signal selecting means then providing to said tone generator a note code corresponding to the contents of said note counter.

* * * * *